US012329264B2

(12) United States Patent
Moran et al.

(10) Patent No.: US 12,329,264 B2
(45) Date of Patent: Jun. 17, 2025

(54) TWO-PART NAIL POLISH CAPSULE

(71) Applicant: Nailomatic Ltd., Tel-Aviv (IL)

(72) Inventors: Omri Moran, Brooklyn, NY (US); Avichay Mor Yosef, Jerusalem (IL); Ron Miller, Herzlia (IL)

(73) Assignee: Nallomatic Ltd., Tel-Aviv (IL)

( * ) Notice: Subject to any disclaimer, the term of this patent is extended or adjusted under 35 U.S.C. 154(b) by 0 days.

(21) Appl. No.: 18/716,580

(22) PCT Filed: Nov. 28, 2022

(86) PCT No.: PCT/IL2022/051262

§ 371 (c)(1),
(2) Date: Jun. 5, 2024

(87) PCT Pub. No.: WO2023/100174

PCT Pub. Date: Jun. 8, 2023

(65) Prior Publication Data

US 2025/0031832 A1 Jan. 30, 2025

Related U.S. Application Data

(60) Provisional application No. 63/286,050, filed on Dec. 5, 2021.

(51) Int. Cl.
*A45D 34/04* (2006.01)
*A45D 40/26* (2006.01)

(52) U.S. Cl.
CPC ..... *A45D 34/046* (2013.01); *A45D 34/048* (2013.01); *A45D 34/045* (2013.01); *A45D 40/265* (2013.01); *A45D 40/267* (2013.01)

(58) Field of Classification Search
CPC .. A45D 34/046; A45D 34/048; A45D 34/045; A45D 40/265; A45D 40/267; A45D 34/042; A45D 40/262

(Continued)

(56) References Cited

U.S. PATENT DOCUMENTS 8,104,985 B2 1/2012 Manici et al.
2003/0172950 A1* 9/2003 Bouix ..... A45D 34/045 132/318

(Continued)

FOREIGN PATENT DOCUMENTS

WO WO 2023/100174 6/2023

OTHER PUBLICATIONS

International Preliminary Report on Patentability Dated Jun. 20, 2024 From the International Bureau of WIPO Re. Application No. PCT/IL2022/051262 (6 Pages).

(Continued)

*Primary Examiner* — David J Walczak

(57) ABSTRACT

A two-part nail polish capsule for use by a nail polish application apparatus comprising a body portion defining a reservoir containing a nail polish fluid and a neck section, and a non-screw detachable cover mechanically coupled to an upper face of the neck section. The non-screw detachable cover having an integrated nail polish applying element comprising a dispensing head and a stem having one or more radial sealing elements and one or more radial wiping elements disposed one above the other. The radial sealing element(s) is configured to fully peripherally contact an inner surface of the neck section when the non-screw detachable cover is attached to the upper face and the stem protrudes into the body portion while the radial wiping element(s) comprise one or more openings configured to enable passage of air between the reservoir and a gap formed between the radial wiping element(s) and the radial sealing element(s).

20 Claims, 13 Drawing Sheets

(58) Field of Classification Search
USPC ..... 401/121, 122, 126–130
See application file for complete search history.

(56) References Cited

U.S. PATENT DOCUMENTS

| | | | | |
|---|---|---|---|---|
| 2009/0324318 | A1* | 12/2009 | Wilde | B65D 75/5855 401/122 |
| 2013/0343800 | A1 | 12/2013 | Drugeon et al. | |
| 2016/0081453 | A1 | 3/2016 | Wightman | |
| 2018/0177281 | A1 | 6/2018 | Pires et al. | |
| 2021/0315362 | A1 | 10/2021 | Zheng et al. | |
| 2023/0200518 | A1* | 6/2023 | Duquet | A45D 40/267 401/129 |

OTHER PUBLICATIONS

International Search Report and the Written Opinion Dated Mar. 2, 2023 From the International Searching Authority Re. Application No. PCT/IL2022/051262 (7 Pages).

* cited by examiner

TWO-PART NAIL POLISH CAPSULE

RELATED APPLICATIONS

This application is a National Phase of PCT Patent Application No. PCT/IL2022/051262 having International filing date of Nov. 28, 2022, which claims the benefit of priority under 35 USC § 119 (e) of U.S. Provisional Patent Application No. 63/286,050 filed on Dec. 5, 2021. The contents of the above applications are all incorporated by reference as if fully set forth herein in their entirety.

FIELD AND BACKGROUND OF THE INVENTION

The present invention, in some embodiments thereof, relates to a two-part nail polish capsule and, more particularly, but not exclusively, to a two-part nail polish capsule comprising a body portion and a non-screw detachable cover integrated with a nail polish applying element for use by an automated nail polish application apparatus.

Applying nail polish to fingernails and/or toenails has been practiced since ancient times. Decorating the finger and/or toe nails is still fashionable in modern times as many people, in particular woman apply nail polish to decorate their fingernails and/or toenails.

Traditionally, manual nail polish application is the most common method. The manual nail polish application may require some expertise, skills and/or experience and may be time consuming. In addition, manual application of the nail polish to one self's nails may be physically challenging due to the need to master the art in both hands and in case of the foot toenails reaching conveniently and efficiently the toes may also present difficulties. While many individuals have mastered the art of applying the nail polish manually for themselves, nail polish application may typically be practiced by professional manicurists and/or pedicurists.

With the advancement of technology and an enabling technical environment, automated nail polish application is becoming more common and popular and automated nail polish application apparatuses are used by more and more users for efficiently applying nail polish.

SUMMARY OF THE INVENTION

According to a first aspect of the present invention there is provided a capsule integrated with a nail polish applying element for usage by a nail polish application apparatus, the capsule comprising a body portion defining a reservoir containing a nail polish fluid and a neck section, and a non-screw detachable cover mechanically coupled to an upper face of the neck section. The non-screw detachable cover having an integrated nail polish applying element comprising a dispensing head and a stem having one or more radial sealing elements and one or more radial wiping elements disposed one above the other. Wherein the one or more radial sealing elements are configured to fully peripherally contact an inner surface of the neck section when the non-screw detachable cover is attached to the upper face and the stem protrudes into the body portion thus sealing the neck section while the one or more radial wiping elements comprising one or more openings configured to enable passage of air between the reservoir and a gap formed between the one or more radial wiping elements and the one or more radial sealing elements.

According to a second aspect of the present invention there is provided a method for manufacturing a capsule integrated with a nail polish applying element for usage by a nail polish application apparatus, comprising:

Producing a body portion defining a reservoir adapted to contain nail polish fluid and a neck section.

Producing a non-screw detachable cover mechanically coupled to an upper face of the neck section, the non-screw detachable cover having an integrated nail polish applying element comprising a dispensing head and a stem having one or more radial sealing elements and one or more radial wiping elements disposed one above the other. The one or more radial sealing element are configured to fully peripherally contact an inner surface of the neck section when the non-screw detachable cover is attached to the upper face and the stem protrudes into the body portion thus sealing the neck section while the one or more radial wiping elements comprising one or more opening configured to enable passage of air between the reservoir and a gap formed between the one or more radial wiping elements and the one or more radial sealing elements.

Inserting the nail polish fluid into the body portion.

Mechanically coupling the non-screw detachable cover to the upper face of the body portion to seal an opening in the upper face.

In a further implementation form of the first and second aspects, the one or more radial wiping elements are disposed on the stem beneath the one or more radial sealing elements.

In a further implementation form of the first and second aspects, the nail polish fluid is a member of a group consisting of: nail polish fluid, base coating fluid, top coating fluid, drying material, nail art polish fluid and medical nail treatment fluid.

In a further implementation form of the first and second aspects, a diameter of the stem is configured to be smaller than the diameter of the neck portion.

In an optional implementation form of the first and second aspects, the one or more radial sealing element constructed of one or more elastic materials are shaped to have a diameter larger than an inner diameter of the neck section.

In an optional implementation form of the first and second aspects, the diameter of the one or more radial sealing elements is limited to induce a predefined detachment force between the non-screw detachable cover and the neck section of the body portion.

In a further implementation form of the first and second aspects, the one or more radial wiping elements constructed of one or more elastic materials are shaped to have a diameter similar to an inner diameter of the neck section.

In a further implementation form of the first and second aspects, the one or more radial wiping elements constructed of one or more elastic materials are shaped to have a diameter larger than an inner diameter of the neck section.

In a further implementation form of the first and second aspects, the one or more radial wiping elements constructed of one or more elastic materials are shaped to have a fork like peripheral edge.

In a further implementation form of the first and second aspects, the one or more openings comprise one or more grooves formed in a peripheral edge of the one or more radial wiping elements such that the one or more radial wiping elements peripherally contact the inner surface of the neck section with the exception of the location of the one or more grooves.

In a further implementation form of the first and second aspects, the one or more openings comprise one or more holes formed in the one or more radial wiping elements.

In a further implementation form of the first and second aspects, the one or more openings are formed by a deformation of a peripheral edge of the one or more radial wiping elements constructed of one or more elastic materials while the one or more radial wiping elements are moved through the neck section portion.

In a further implementation form of the first and second aspects, the one or more radial wiping elements are constructed of one or more porous materials which are air permeable such that the one or more openings are formed by the air permeable characteristic of the one or more porous materials.

In a further implementation form of the first and second aspects, a distance of the one or more radial sealing elements from the upper face is set according to a predefined ratio between: (1) a volume of a top space formed between the one or more radial sealing elements and the upper face when the non-screw detachable cover is coupled to the upper face, and (2) a volume of an overall space formed between a top surface of the nail polish fluid contained in the body portion and the upper face while the capsule is horizontally leveled with the neck section facing upwards.

In an optional implementation form of the first and second aspects, the one or more radial sealing elements and/or the one or more radial wiping elements are shaped to limit a lateral movement of the non-screw detachable cover.

In a further implementation form of the first and second aspects, the one or more radial wiping elements are configured to push, towards the reservoir, nail polish fluid residues accumulated on the inner surface of the neck section when the non-screw detachable cover is moved to wipe the dispensing head against the inner surface to remove excessive nail polish fluid from the dispensing head.

In a further implementation form of the first and second aspects, the excessive nail polish fluid is removed from the dispensing head by moving the non-screw detachable cover in one or more movement patterns with respect to the neck section. The one or more movement patterns are members of a group consisting of: a side-to-side movement, a forward-backward movement, an up-down movement, and a circular movement.

In a further implementation form of the first and second aspects, an amount of excessive nail polish removed from the dispensing head is computed to leave an amount of nail polish fluid on the dispensing head which is sufficient for application on one or more nail surfaces.

In an optional implementation form of the first and second aspects, an amount of excessive nail polish fluid removed from the dispensing head is defined by contact area between the dispensing head and the inner surface of the neck section defined by a depth of inserting the dispensing head into the neck section.

In a further implementation form of the first and second aspects, the non-screw detachable cover is shaped to enable a mounting element of the nail polish application apparatus to grab and hold the non-screw detachable cover.

In a further implementation form of the first and second aspects, the dispensing head is constructed of one or more members of a group consisting of: a plurality of hair strands and one or more elastic filaments.

In an optional implementation form of the first and second aspects, an axial sealing element disposed between the non-screw detachable cover and the upper face.

In an optional implementation form of the first and second aspects, one or more stirring objects disposed inside the reservoir for stirring the nail polish fluid when the capsule is shaken.

In an optional implementation form of the first and second aspects, one or more identification means comprising identification data of the capsule.

In an optional implementation form of the first and second aspects, a rippable sealing element is disposed over at least part of the non-screw detachable cover and at least part of the neck section.

In an optional implementation form of the first and second aspect, one or more identification means are coupled to the capsule. The one or more identification means comprising identification data of the capsule.

In an optional implementation form of the first and second aspect, the capsule is packed in a package configured to accommodate one or more capsules. The package is further configured to limit movement of the detachable cover with respect to the body portion in a longitudinal axis of the capsule.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Implementation of the method and/or system of embodiments of the invention can involve performing or completing selected tasks automatically. Moreover, according to actual instrumentation and equipment of embodiments of the method and/or system of the invention, several selected tasks could be implemented by hardware, by software or by firmware or by a combination thereof using an operating system.

BRIEF DESCRIPTION OF THE SEVERAL VIEWS OF THE DRAWINGS

Some embodiments of the invention are herein described, by way of example only, with reference to the accompanying drawings. With specific reference now to the drawings in detail, it is stressed that the particulars are shown by way of example and for purposes of illustrative discussion of embodiments of the invention. In this regard, the description taken with the drawings makes apparent to those skilled in the art how embodiments of the invention may be practiced.

In the drawings.

DETAILED DESCRIPTION OF EMBODIMENTS OF THE INVENTION

Figure 1:
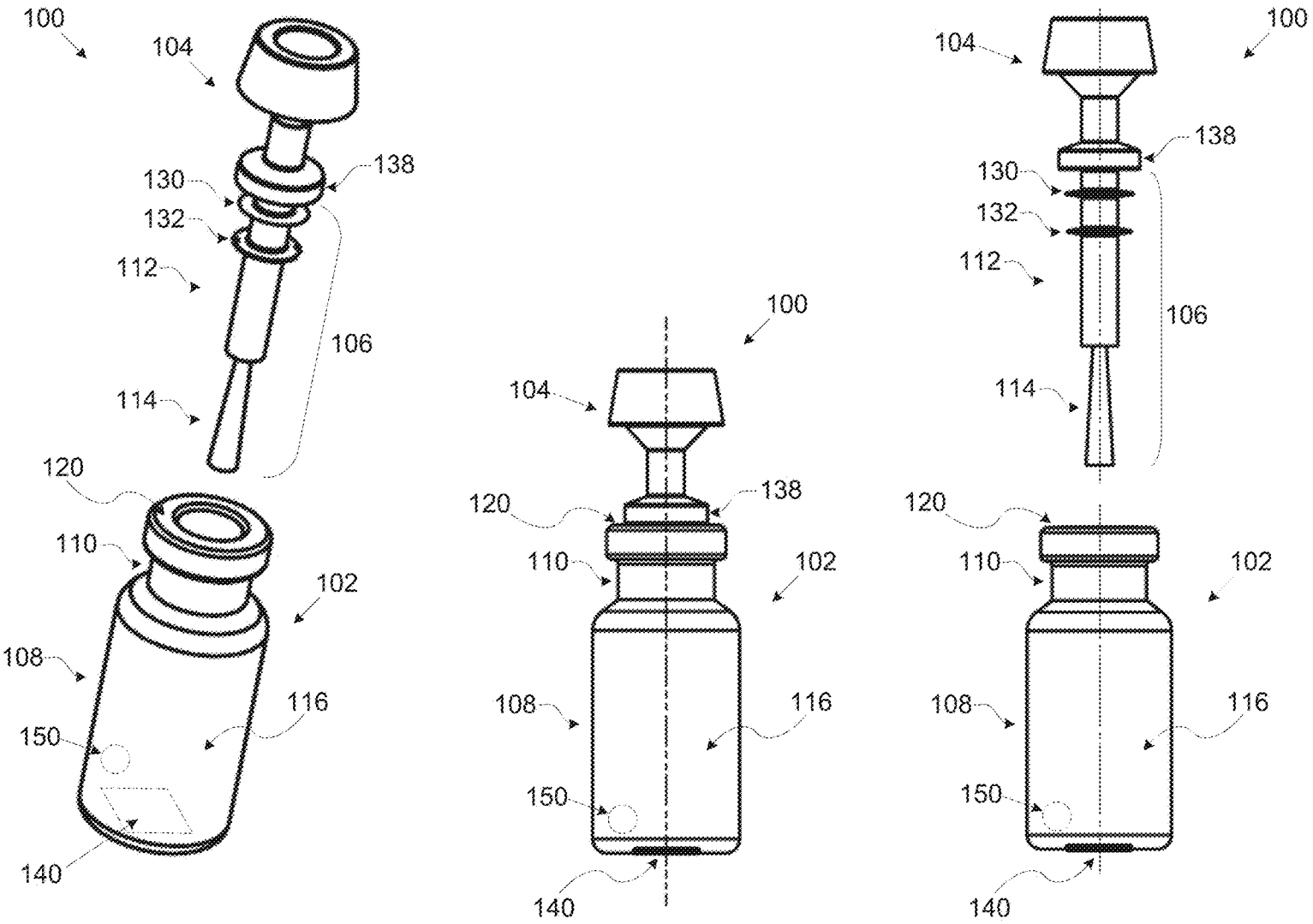
FIG. 1 presents perspective views of an exemplary two-part nail polish capsule comprising a body portion and a non-screw detachable cover integrated with a nail polish applying element for use by a nail polish application apparatus, according to some embodiments of the present invention.

The present invention, in some embodiments thereof, relates to a two-part nail polish capsule and, more particularly, but not exclusively, to a two-part nail polish capsule comprising a body portion and a non-screw detachable cover integrated with a nail polish applying element for use by an automated nail polish application apparatus.

According to some embodiments of the present invention there is provided a two-part nail polish capsule for use by a nail polish application apparatus which comprises a body portion containing nail polish fluid and a non-screw detachable cover having an integrated nail polish applying element which is attached and/or mechanically coupled to the body portion to seal the body portion.

The body portion, typically a flask shaped body portion, which may be constructed in one of a plurality of shapes, for example, a cylinder, a cone, a pyramid, a box, a cup shape and/or the like may define a reservoir congaing the nail polish fluid, for example, a polish fluid, a base coating fluid, a top coating fluid, a drying material, a nail art polish fluid, a medical nail treatment fluid and/or the like and a neck section. The capsule which may optionally be a disposable capsule intended for a one or more application sessions of the nail polish fluid may be used by one or more automated nail polish application apparatuses such that the amount of nail polish fluid contained in the body portion may be defined for a one or more application sessions.

The detachable cover may be mechanically coupled to the body portion through one or more technologies and/or implementations, for example, press-fit, clamping, clasping, fastening, gluing and/or the like. This means the detachable cover is a non-screw cover meaning it is not screwed to the body portion and hence requires no screw and/or rotation operations to be detach from and/or attach to the body portion.

The non-screw detachable cover may be configured, shaped and/or adapted to support a mounting element of the nail polish apparatus to grasp the non-screw detachable cover and maneuver it to move the integrated nail polish applying element in order to collect the nail polish fluid from the reservoir defend by the body portion and apply the nail polish fluid to one or more nail surfaces of a user's fingers and/or toes. The non-screw detachable cover may be therefore shaped to include one or more mechanical mounting provisions, for example, a protrusion, a groove, a cavity and/or the like which may optionally be part of the inherent shape of the non-screw detachable cover to support the mounting element of the to collect, grasp, lock and/or the like of the detachable cover.

The nail polish applying element integrated with the detachable cover may be therefore typically constructed of a stem protruding from a bottom face of the detachable cover and a dispensing head configured and adapted to collect the nail polish and apply it to the nail surfaces. One or more dimensions of the stem, for example, a diameter, a length and/or the like may be shaped and adapted to one or more dimensions of the body portion, for example, an inner diameter a longitudinal dimension of the body portion such that when attaching the detachable cover to the upper face of the body portion, the dispensing head is dipped in the nail polish fluid contained in the body portion.

The stem may include one or more radial sealing elements configured to seal the body portion in order to prevent spill and/or evaporation of the nail polish fluid and/or one or more of its components from the body portion. The radial sealing element(s) may be therefore configured to fully peripherally contact an inner surface of the neck section of the body portion when the non-screw detachable cover is attached to an upper face of the neck section and the stem protrudes into the reservoir defined by the body portion. In particular, the radial sealing element(s) which may be at least partially elastic may be shaped to have a diameter larger than an inner diameter of the neck section such that the radial sealing element(s) may effectively seal the neck section and hence the body portion. The radial sealing element(s) which are at least partially elastic may bend, twist, curve and/or the like when the stem is inserted into the body portion thus at least slightly overlapping with the inner surface of the neck section and coming in full contact peripherally with the inner surface of the neck section to effectively seal the neck section.

The stem may further include one or more radial wiping elements disposed below (beneath) the radial sealing element(s) and configured to push, towards the reservoir, residues of the nail polish fluid accumulated on the inner surface of the neck section. Optionally, the radial wiping element(s) may disposed on the stem above the radial sealing element(s).

The radial wiping element(s) may be shaped to have a diameter similar to and/or larger than the inner diameter of the neck section such that the radial wiping element(s) may effectively collect the nail polish fluid residues and push them towards the reservoir. Optionally, one or more of the radial wiping element(s) may be shaped, constructed and/or configured to have a fork-like peripheral edge, specifically a flexible fork-like peripheral edge to improve efficiency of pushing the nail polish fluid residues towards the reservoir.

However, unlike the radial sealing element(s), the radial wiping element(s) must not seal the neck section since such sealing may affect the detachment and/or attachment force required for detaching and/or attaching the non-screw detachable cover to/from the body portion.

Each radial wiping element may be therefore shaped and configured to have one or more openings configured to enable passage of air between the reservoir defined by the body portion and a gap formed between the radial wiping element(s) and the radial sealing element(s) disposed on the stem above the radial wiping element(s). In case of multiple radial sealing element and/or radial wiping element, the gap may be formed between a top most (highest) radial wiping element and a bottom most (lowest) radial sealing element.

One or more techniques, structures and/or implementations may be applied for forming and/or utilizing the opening(s) in the radial wiping element(s). Moreover, in case multiple radial wiping elements are disposed on the stem, different openings may be applied in one or more of the multiple radial wiping elements.

For example, the opening(s) in one or more of the radial wiping element(s) may include one or more grooves formed at a peripheral edge (border) of the respective radial wiping element such that the respective radial wiping element may be in contact with the inner surface of the neck section with the exception of the location(s) of the groove(s) forming opening(s) through which air may pass (flow) from one side of the respective radial wiping element to the other, i.e., from the reservoir to the neck section and vice versa, from the neck section to the reservoir. In another example, the opening(s) in one or more of the radial wiping element(s) may include one or more holes formed in the respective radial wiping element though which air may pass (flow) from one side of the radial wiping element to the other. In another example, one or more of the radial wiping element(s) may constructed of one or more elastic materials such that the respective radial wiping element may be formed by deformation of at least part of the respective radial wiping element while the respective radial wiping element is moved through the neck section portion thus enabling air to pass from one side of the respective radial wiping element to the other.

In another example, at least part of one or more of the radial wiping element(s) may be constructed of one or more air permeable and/or porous materials which may allow passage of air through them, for example, a sponge and/or the like which is not be sealed and enables air to pass from one side of the respective radial wiping element to the other. Optionally, the sponge may be disposed on the peripheral edge of one or more of the radial wiping element(s) to increase wiping efficiency of the radial wiping element(s) in wiping the nail polish fluid residues from the inner surface of the neck section.

The diameter of the radial sealing element(s) and/or the diameter of the radial wiping element(s) may be set and/or limited to induce a predefined detachment (and/or attachment) force between the non-screw detachable cover and the neck section of the body portion. Moreover, the diameter may be limited such that combined with the detachment force induced by the mechanical coupling between the detachable cover and the body portion may induce a predefined detachment force, specifically a low detachment force, for example, 10 N (newton) requiring the nail polish applying element to apply limited force to open/close the capsule, i.e., detach and attach the non-screw detachable cover from and to the body portion.

Furthermore, the detachment force may be affected by the volume of air that is pressed in the body portion when the capsule is in closed state, i.e., the non-screw detachable cover is attached (coupled) to the body portion. Complementary, the attachment force may be affected by the volume of air that needs to be pressed into the body portion when closing the capsule from an open state, i.e., when attaching the non-screw detachable cover to the body portion.

Specifically, the detachment and attachment force may be affected by the amount of air that is pressed in the body portion when the capsule is in closed state. In open state of the capsule, when the non-screw detachable cover is not covering the body portion, air may fill an overall space defined between the top surface of the nail polish fluid contained in the body portion and the upper surface of the neck section of the body portion. However, in the closed state, the air which initially occupied the entire overall space is now pressed in a smaller volume space defined between the top surface of the nail polish fluid and the radial sealing element, specifically the lower most radial sealing element in case of multiple sealing elements. The air contained in the smaller volume space may therefore induce a pressure that may affect the detachment and attachment force.

The height, i.e., the distance of the radial sealing element (lower most radial scaling element is applicable) may be therefore set according to a predefined ratio between the volume of the space in the closed state and the volume of the space in the open state where the ratio may be predefined according to the detachment and attachment force that the nail polish application apparatuses may need to apply in order to open and close the capsule.

Optionally, the capsule may include an axial sealing element, for example, an O-ring, a gasket, an annular ring and/or the like disposed between the non-screw detachable cover and the upper face of the neck section of the body portion to further seal the capsule to prevent spill and/or evaporation of the nail polish fluid and/or its component(s) from the body portion.

Optionally, the capsule may include one or more identification elements expressing identification data of the capsule which may be extracted and used by one or more of the nail polish application apparatuses. The identification data may include, for example, type, compatibility with nail polish apparatuses (models), type of the contained nail polish fluid, expiration date, manufacturing date, manufacturing batch and/or the like. The identification elements may be implemented using one or more methods and/or technologies, for example, one or more labels encoding the identification data, one or more Radio Frequency Identification (RFID) tags storing the identification data, one or more Near Field Communication (NFC) components storing the identification data and/or the like.

Optionally, one or more stirring objects, for example, a ball, a ring and/or the like may be disposed inside the body portion such that when the capsule is shaken, manually and/or automatically, the stirring object(s) may move inside the body portion thus stirring the nail polish fluid. This may significantly improve distribution of the composition of the nail polish fluid in the body portion to be more homogenous and hence increase smoothness and uniformity of the nail polish and improve the application of the nail polish application on the nail surface(s).

Optionally, the capsule may be wrapped using one or more rippable sealing elements, for example, a metal foil, a polymeric foil and/or the like in order to further improve robustness of the capsule to spillage and/or evaporation of the nail polish fluid and/or its composition materials.

Optionally, the capsule may be further packed in one or more packages configured to receive and accommodate one or more capsules. The package may be designed to further ensure the sealing of the capsule(s) by limiting and/or preventing movement of the detachable cover with respect to the body portion, specifically in a longitudinal axis of the capsule. The package may be further designed and configured to maintain a predefined pressure to press the non-screw detachable cover against the body portion.

The two-part capsule comprising a body portion and a non-screw detachable cover mechanically coupled to the body portion to seal it may present major benefits and advantages.

First, the capsule may be easily used by an automated nail polish application apparatus since attachment/detachment of the detachable cover to the body portion is not utilized by a screwing mechanism hence no complex rotation and/or screwing operations and/or mechanisms are required by the nail polish application apparatus. This may significantly reduce the complexity and/or cost of the nail polish application apparatus. In addition, the detachable cover may be shaped and constructed to support the nail polish apparatus to easily, efficiently and firmly collect, grasp and hold the detachable cover for effective and accurate application of the nail polish fluid on the nail surface(s) of the user.

Moreover, disposing the radial sealing element(s) on the stem of the nail polish application element integrated with the detachable cover may efficiently seal the body portion to prevent spillage and/or evaporation of the nail polish fluid and/or of one or more of its components thus ensuring high quality nail polish fluid applied on the nail surface(s).

Since they seal the body portion, the radial sealing element(s) may also prevent air from escaping the body portion when the capsule is being closed once the radial sealing element(s) comes in contact with the inner surface of the neck section. The locked air which is gradually pressed into a smaller volume space may therefore induce internal pressure in the body portion which may affect the detachment and attachment force of the detachable cover to the body portion. The ratio between the volume of space containing the air in the closed state and the volume of space containing the air in the open state may define the internal air pressure which in turn defines and/or affects the detachment and attachment force. The nail polish applying element integrated with the detachable cover may be therefore configured and shaped to locate the radial sealing element(s) at a certain distance from the upper face of the neck section of the body portion according to predefined ratio. The predefined ratio may be defined based on the detachment and attachment force available to the nail polish application apparatuses(s), for example, 10 N.

Furthermore, disposing the radial wiping element(s) on the stem of the nail polish application element may serve to efficiently remove the nail polish fluid residues accumulated on the inner surface of the neck section of the body portion. These residues, if not removed and pushed back into the reservoir storing the nail polish fluid may dry on the neck section and may clog the neck section potentially blocking it at least partially thus preventing efficient insertion of the dispensing head of the nail polish application element into the body portion and dipping it in the nail polish fluid contained in the reservoir. Moreover, the at least partially dried nail polish fluid residues may mix with fresh nail polish fluid collected by the dispensing head from the reservoir and may thus reducing homogeneousness of the of the nail polish fluid applied on the nail surface(s) resulting is a degraded quality, visibility and/or appearance of the nail surfaces coated with the nail polish non-homogenous nail polish fluid.

However, while configured to wipe the nail polish fluid residues, the radial wiping elements comprising the opening(s) may not seal the neck section and may thus not affect the amount of air captured in the body portion thus not affecting the ratio between the volumes of space containing the air in the open and closed states of the capsule and thus not affecting the detachment/attachment force required by the nail polish application apparatus.

In addition, wrapping the capsule using the rippable sealing element(s) and or packing the capsule in the package configured to limit and potentially prevent movement of the detachable cover with respect to the body portion in a longitudinal axis of the capsule. Limiting the movement of the detachable cover with respect to the body portion may ensure that the detachable cover and the body portion are efficiently and constantly connected to each other optionally under some pressure thus efficiently and constantly sealing the capsule. The improved sealing may prevent spillage and/or evaporation of the nail polish fluid and/or its composition materials from the capsule, in particular under extreme conditions, for example, high and/or low temperature, high and/or low pressure and/or the like which the capsule may be subject to, for example, during transportation, shipping, handling and/or storage.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Referring now to the drawings, FIG. 1 presents perspective views of an exemplary two-part nail polish capsule comprising a body portion and a non-screw detachable cover integrated with a nail polish applying element for use by a nail polish application apparatus, according to some embodiments of the present invention.

An exemplary two-part capsule 100 intended for use by one or more nail polish application apparatuses which control the actual nail polish application process may be a single application of nail polish on nail surface(s) of the user, for example, hand finger nails and/or foot toe nails.

The two-part capsule 100 may be constructed of a body portion 102, typically a flask shaped body portion and a detachable cover (cap) 104 attached and/or mechanically coupled to the body portion 102 to seal an opening in an upper face of the body portion 102.

The body portion 102 which defines a reservoir 108 and a neck section 110 may be constructed in one of a plurality of shapes, for example, a cylinder, a cone, a pyramid, a box, a cup shape and/or the like. The reservoir 108 may contain a nail polish fluid 116, for example, a polish fluid, a base coating fluid, a top coating fluid, a drying material, a nail art polish fluid, a medical nail treatment fluid and/or the like.

The body portion 102 and the detachable cover 104 may be produced from one or more materials, for example, a polymer, glass, metal, a ceramic material and/or the like. The body portion 102 and/or detachable cover 104 may be air sealed to prevent the nail polish fluid from contacting the air. Optionally, the body portion 102 and/or the detachable cover 104 may be produced from one or more materials characterized by a low permeability coefficient to prevent one or more components of the nail polish fluid, for example, solvents from diffusing and evaporating over time.

The detachable cover 104 may be mechanically coupled to the body portion 102 through one or more techniques, methods and/or implementations, for example, press-fit, clamping, clasping, fastening, gluing and/or the like. However, the detachable cover 104 is a non-screw detachable cover meaning it is not screwed to the body portion 102 and hence no screw and/or rotation operation(s) of the detachable cover 104 and/or of the body portion 102 is required to detach and/or attach the detachable cover 104 from the body portion 102.

Moreover, the detachable cover 104 may be attached and/or mechanically coupled to the body portion 102 with a predefined strength and/or force which may suffice for sealing the body portion 102 while handling the capsule 100 and/or while preparing for the nail polish application session. Strength of the mechanical coupling between the detachable cover 104 and the body portion 102 may be predefined, for example, in terms of detachment (and/or attachment) force, for example, 10 N.

The non-screw detachable cover 104 is integrated with nail polish applying element 106 which may be mechanically coupled and/or integrated to the detachable cover 104, typically to a bottom face of the detachable cover 104 such that when the capsule 100 is in closed state in which the detachable cover 104 is attached to the body portion 102, the nail polish applying element 106 protrudes into the body portion 102.

The non-screw detachable cover 104 may be shaped to enable a mounting element of the nail polish application apparatus to receive and accommodate, for example, grab and hold the non-screw detachable cover 104 in an efficient and firm manner such that the non-screw detachable cover 104 and its integrated nail polish applying element 106 are firmly secured in the mounting element.

The nail polish applying element 106 integrated with the detachable cover 104 may be typically constructed of a stem 112 and a dispensing head 114. A first (proximal) end of the stem 112 is mechanically coupled and/or integrated to the detachable cover, specifically to a bottom face of the detachable cover 104 while a second (distal) end of the stem 112 is mechanically coupled and/or integrated with the dispensing head 114.

The stem 112 may be constructed, produced and/or designed to have a length adapted to the size of the body portion 102 such that when the detachable cover 104 is maneuvered to insert the nail polish applying element 106 into the body portion 102 108, the dispensing head 114 dips in the nail polish fluid 116 contained in the reservoir 108. The stem 112 may be therefore configured to have a diameter smaller than an inner diameter of the neck section 110 such that nail polish applying element 106 may be inserted into the body portion 102.

The stem 112 may include one or more radial sealing elements 130 configured to fully peripherally contact an inner surface of the neck section 110 when the non-screw detachable cover 104 is attached to an upper face 120 of the neck section 110 and the stem 112 protrudes into the body portion 102. The radial sealing elements 130 may be disposed to prevent spill and/or evaporation of the nail polish fluid 116 and/or one or more of its components from the body portion 102.

The stem 112 may further include one or more radial wiping elements 132 disposed below (beneath) the radial sealing element(s) 130 and configured to push, towards the reservoir 108, residues of the nail polish fluid 116 accumulated on the inner surface of the neck section 110. The radial wiping element(s) 132 may be shaped to peripherally contact the inner surface of the neck section 110 when the non-screw detachable cover 104 is attached to an upper face 120 of the neck section 110 and the stem 112 protrudes into the body portion 102. However, each of the radial wiping element(s) 132 may be further shaped to include one or more openings through which air may pass from one side of the respective radial wiping element 132 to the other, i.e., from the reservoir 108 to the neck section 110 and vice versa, from the neck section 110 to the reservoir 108 to prevent sealing of the reservoir 108.

Typically, one or more of the radial wiping elements 132 may be disposed on the stem 112 above one or more of the radial sealing element(s) 130. However, optionally, a plurality of radial wiping elements 132 and a plurality of radial sealing elements 130 may be disposed alternatingly on the stem 112 in alternating order. For example, a first radial sealing element 130 may be disposed on the stem 112 above a first radial wiping element 132 which may be disposed above a second radial sealing element 130 which may be disposed above a second radial wiping element 132.

Optionally, one or more of the radial sealing elements 130 may be configured to push, towards the reservoir 108, residues of the nail polish fluid 116 accumulated on the inner surface of the neck section 110.

Optionally, the capsule 100 may include an axial sealing element 138 disposed between the non-screw detachable cover 104 and the upper face 120 of the neck section 110 of the body portion 102 to further seal the capsule 100 to prevent spill and/or evaporation of the nail polish fluid 116 and/or one or more of its components from the body portion 102. Specifically, the axial scaling element 138 may be disposed on the non-screw detachable cover 104 above the stem 112 of the nail polish applying element 106 such that the axial sealing element 138 may effectively seal the opening in the neck section 110 when the nail polish applying 106 is inserted into the body portion 102 and the non-screw detachable cover 104 is attached to the upper face 120. The axial scaling element 138, for example, an O-ring, a gasket, an annular ring and/or the like may be produced of one or more materials having a high elasticity coefficient such that after mechanically coupling the detachable cover 104 to the body portion 102, the axial sealing element 138 may efficiently seal the opening in the neck section 110.

Optionally, the capsule 100 may include one or more identification elements 140 expressing identification data of the capsule 100, for example, a type of the capsule 100 (e.g. structure, capacity, etc.), compatibility with nail polish apparatuses (models), a type of the contained nail polish fluid 116, an expiration date of the nail polish fluid 116, a manufacturing date, a manufacturing batch and/or the like.

Specifically, the identification data may be extracted and used by one or more of the nail polish application apparatuses configured to use the capsule 100. The identification elements 140 may be therefore directed and applied to the capsule 100 for detection and interpretation by the nail polish application apparatus(s).

The identification elements 140 may be therefore placed and/or located on and/or in the capsule 100 to be efficiently detected and/or presented to one or more of the nail polish application apparatuses configured accordingly. For example, the identification elements 140 may be attached, coupled and/or integrated to a bottom face of the capsule 100.

The identification elements 140 may be implemented using one or more methods and/or technologies. For example, the identification elements 140 may include one or more labels printed, attached and/or otherwise marked on the capsule 100 which may express the identification data. For example, the label(s) may comprise one or more codes, for example, a barcode, a QR code and/or the like in which the identification data of the capsule 100 may be encoded. One or more of the nail polish application apparatuses may be configured to visually detect and analyze the code(s) to extract the encoded identification data. In another example, the identification elements 140 may include one or more NFC devices attached, integrated and/or otherwise coupled to the capsule 100. The NFC device(s) may store the identification data of the capsule 100 such that one or more of the nail polish application apparatuses configured accordingly may communicate with the NFC device(s) of the capsule 100 and extract the stored identification data. In another example, the identification elements 140 may include one or more Radio Frequency Identification (RFID) tags attached, integrated and/or otherwise coupled to the capsule 100. The RFID tag(s) may store the identification data of the capsule 100 such that one or more of the nail polish application apparatuses configured accordingly may communicate with the RFID tag(s) of the capsule 100 and extract the stored identification data.

Optionally, the identification data encoded, stored and/or otherwise available in the identification elements 140 is encrypted using one or more encryption methods, techniques and/or algorithms as known in the art. In such case, the nail polish application apparatuses may apply one or more respective decryption algorithms typically using a secret value (e.g. password, code, etc.) to decipher the encrypted data extracted from the identification elements 140.

Optionally, one or more stirring objects 150, for example, a ball, a ring and/or the like may be disposed inside the body portion 108. When shaking the capsule 100, the stirring object(s) 150 may move inside the body portion 102 thus stirring the nail polish fluid 116. This may improve a homogenous distribution of the composition of the nail polish fluid 116. Shaking the capsule 100 may be done manually by the user before placing the capsule 100 in the nail polish application apparatus. However, optionally, one or more of the nail polish application apparatuses may be configured, adapted and/or operated to shake automatically the capsule 100.

Optionally, the capsule 100 may be wrapped using one or more rippable scaling elements, for example, a metal foil, a polymeric foil and/or the like in order to prevent spill and/or evaporation of the nail polish fluid and/or one or more materials composing the nail polish fluid, for example, a solvent and/or the like. In particular, the rippable scaling element(s) may be disposed over at least part of the non-screw detachable cover 104 and at least part of the body portion 102, specifically at least part of the neck section 110 to seal the area of the upper face 120 where the non-screw detachable cover 104 is attached to the neck section 110.

Figure 2:
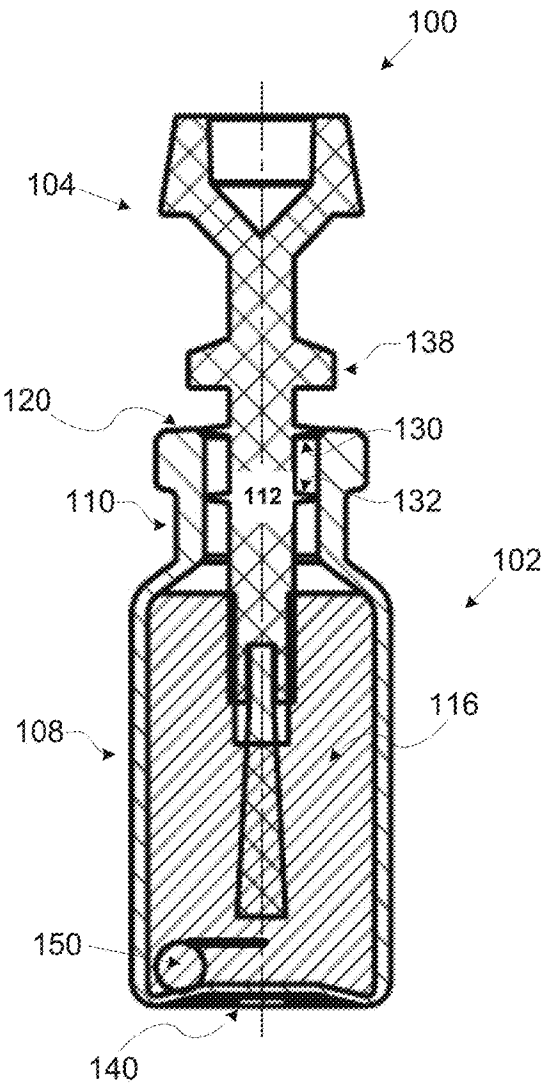
FIG. 2 presents cross section views of slightly open and closed states of an exemplary two-part nail polish capsule comprising a body portion and a non-screw detachable cover integrated with a nail polish applying element for use by a nail polish application apparatus, according to some embodiments of the present invention.
Figure 2:
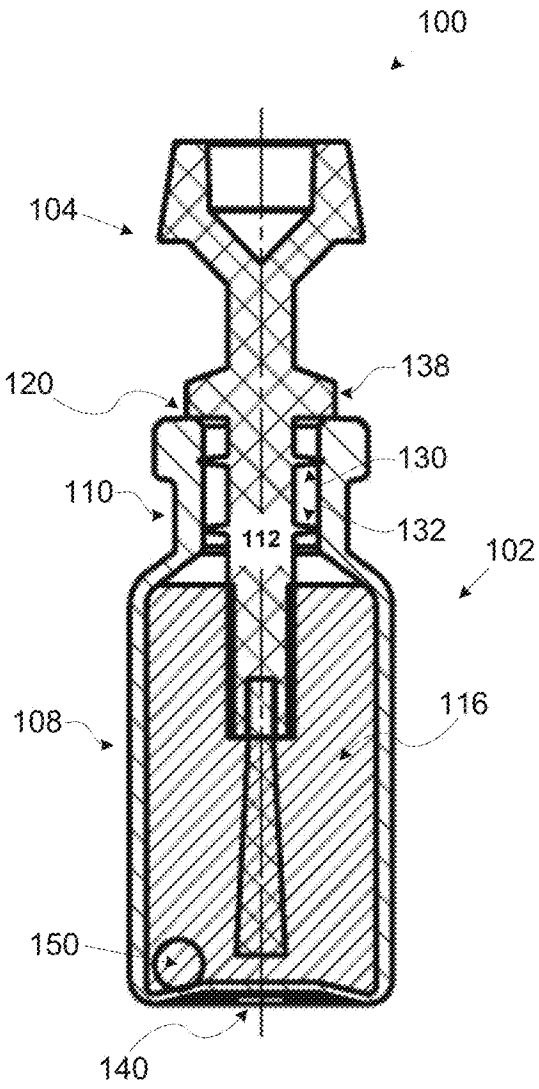

Reference is now made to FIG. 2, which presents cross section views of slightly open and closed states of an exemplary two-part nail polish capsule comprising a body portion and a non-screw detachable cover integrated with a nail polish applying element for use by a nail polish application apparatus, according to some embodiments of the present invention.

FIG. 2 presents cross section views of a two-part nail polish capsule such as the capsule 100 in a closed state (left) and in a slightly open state (right). As described herein before, the capsule 100 is constructed of two parts, namely a body portion such as the body portion 102 and a non-screw detachable cover such as the non-screw detachable cover 104 integrated with a nail polish applying element such as the nail polish applying element 106 where the body portion 102 defines a reservoir such as the reservoir 108 and a neck section such as the neck section 110.

As seen, a radial sealing element such as the radial sealing element 130 may be disposed on a stem such as the stem 112 of the nail polish applying element 106 for sealing the body portion 102, specifically for sealing the neck section 110 to prevent spill and/or evaporation of the nail polish fluid 116 and/or one or more of its components contained in the reservoir 108. This however should not be construed as limiting since a plurality of radial sealing elements such as the radial sealing element 130 may be disposed on the stem 112 for sealing the neck section 110.

The radial sealing element 130 which may be constructed of one or more elastic materials having a high elasticity coefficient may be shaped to have a diameter larger than an inner diameter of the neck section 110 such that the radial sealing element 130 may effectively seal the neck section 110 and hence the body portion 102. As it is at least partially elastic, the radial scaling element 130 may slightly bend, twist, curve and/or the like when the stem 112 is inserted into the body portion 102 thus at least slightly overlap with the inner surface of the neck section 110 and come in significantly full contact peripherally with the inner surface of the neck section 110 to effectively seal the neck section 110.

Moreover, the diameter of each radial sealing element 130 may be limited to induce a predefined detachment (and/or attachment) force between the non-screw detachable cover 104 and the neck section 110 of the body portion 102. In particular, the diameter of each sealing element 130 may be limited to a diameter that combined with the detachment force induced by the mechanical coupling between the detachable cover 104 and the body portion 102 may induce a predefined detachment force, for example, 10 N.

In addition, a radial wiping element such as the radial wiping element 132 may be disposed on the stem 112, below the radial sealing element 130, for wiping residues of the nail polish fluid 116 from the neck portion 110, specifically for pushing, towards the reservoir 108, the nail polish fluid 116 residues accumulated on the inner surface of the neck section 110. For brevity, a single radial wiping element 132 is described herein after. This, however, should not be construed as limiting since a plurality of radial wiping elements such as the radial wiping element 132 may be disposed on the stem 112 for wiping the nail polish fluid 116 residues.

The radial wiping element 132 may be shaped, configured and/or constructed to include one or more groves such that the radial wiping element(s) 132 may not fully seal the neck portion 110.

The radial wiping element 132 may employ one or more structures, designs and/or implementations. For example, the radial wiping element 132 may be constructed of one or more rigid materials having a low elasticity coefficient and may be therefore significantly rigid. In another example, the radial wiping element 132 may be constructed of one or more elastic materials having a high elasticity coefficient and may be therefore significantly elastic.

The radial wiping element 132 may be shaped to have a diameter similar to the inner diameter of the neck section 110 such that the radial wiping element 132 may effectively collect the residues of the nail polish fluid 116 accumulated on the inner surface of the neck section 110 and push them towards the reservoir 108. Optionally, the radial wiping element 132 may be shaped to have a diameter larger than the inner diameter of the neck section 110 to further increase collection of the nail polish fluid 116 residues accumulated on the inner surface of the neck section 110 and push them towards the reservoir 108. As it is at least partially elastic, the radial wiping element 132 may slightly bend, twist, curve, compressed and/or the like when the stem 112 is inserted into the body portion 102 and may at least slightly overlap with the inner surface of the neck section 110 thus coming in significantly full contact peripherally with the inner surface of the neck section 110 to effectively collected the nail polish fluid 116 residues and push them towards the reservoir 108.

Moreover, as described for the radial sealing element 130, the diameter of each radial wiping element 132 may be also limited to induce the predefined detachment (and/or attachment) force between the non-screw detachable cover 104 and the neck section 110 of the body portion 102.

However, regardless of whether the diameter of the radial wiping element 132 is similar or larger than the inner diameter of the neck section 110, the radial wiping element 132 is shaped and configured to have its opening(s) open to enable passage of air between the reservoir 108 and a gap formed between the radial wiping element 132 and the radial sealing element 130. As such, when the non-screw detachable cover 104 is attached to an upper face 120 of the neck section 110 and the stem 112 protrudes into the body portion 102, while the radial wiping element(s) 132 may peripherally contact the inner surface of the neck section 110, the radial wiping element(s) 132 may not seal the reservoir 108.

Therefore, when the nail polish applying element 106 is inserted into the body portion 102, the radial wiping element 132 may push residues of the nail polish fluid 116 accumulated on the inner surface of the neck section 110 while the opening(s) enable passage of air between the reservoir 108 and a gap formed between the radial wiping element 132 and the radial sealing element 130.

In case multiple radial sealing elements 130 and/or multiple radial wiping elements 132 are disposed on the stem 112, the gap may be defined between and the upper most radial wiping element 132 and the lower most radial sealing element 130.

Due to their different functionality, a rigidity and/or elasticity of the radial sealing element(s) 130 may be different from the rigidity and/or elasticity the radial wiping element(s) 132. For example, since the radial sealing element(s) 130 are configured to seal the capsule 100, the radial sealing element(s) 130 may be more clastic to improve the sealing of the neck section 110. The radial wiping element(s) 132 on the other hand may be more rigid which may serve to more efficiently collect the residues of the nail polish fluid 116 from the inner surface of the neck section 110. The rigidity and/or elasticity level of the radial sealing element(s) 130 and the radial wiping element(s) 132 may be achieved using one or more methods as known in the art.

For example, the radial sealing element(s) 130 may be produced using one or more materials characterized by higher elasticity while the radial wiping element(s) 132 may be produced using one or more materials characterized by lower elasticity. In another example, the radial sealing element(s) 130 may be configured to be more elastic compared to the radial wiping element(s) 132 by producing the two elements using the same materials but with one or more different constructions parameters. For example, the radial sealing element(s) 130 may be configured to be thinner than the radial wiping element(s) 132 thus making the radial scaling element(s) 130 more clastic than the radial wiping element(s) 132. In another example, the radial sealing element(s) 130 may be configured to have a sharp or rounded edge making the edge (lip) of the radial sealing element(s) 130 more elastic than that of the radial wiping element(s) 132.

Reference is now made to FIG. 3A, FIG. 3B, FIG. 3C, FIG. 3D, FIG. 3E, FIG. 3F, FIG. 3G, FIG. 3H and FIG. 3I, which present views of exemplary radial wiping elements of an exemplary two-part nail polish capsule comprising a body portion and a non-screw detachable cover integrated with a nail polish applying element for use by a nail polish application apparatus, according to some embodiments of the present invention.

Figure 3A:
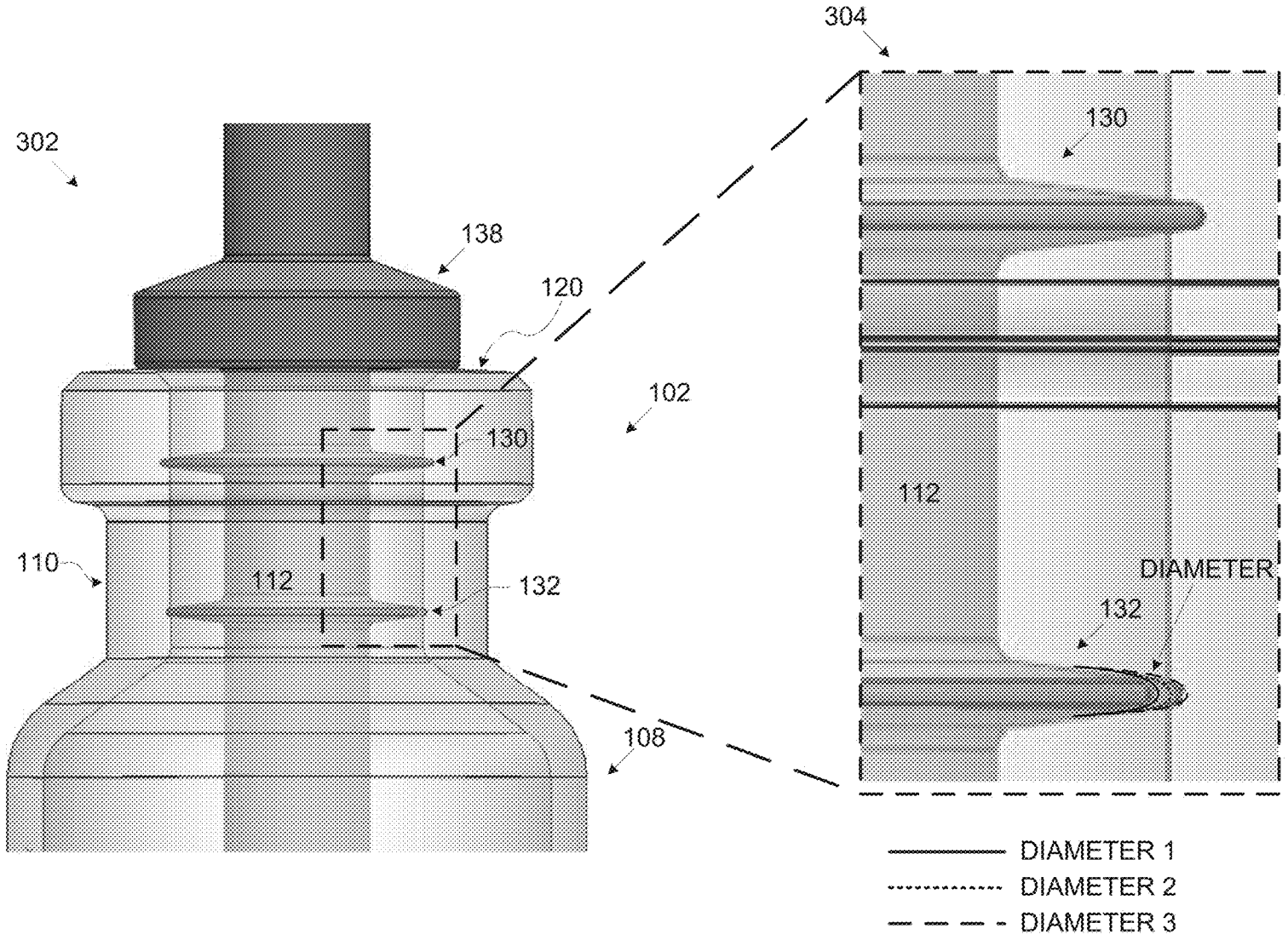
FIG. 3A, FIG. 3B, FIG. 3C, FIG. 3D, FIG. 3E, FIG. 3F, FIG. 3G, FIG. 3H and FIG. 3I present views of exemplary radial wiping elements of an exemplary two-part nail polish capsule comprising a body portion and a non-screw detachable cover integrated with a nail polish applying element for use by a nail polish application apparatus, according to some embodiments of the present invention.

FIG. 3A presents a perspective view 302 of a section of an exemplary capsule such as the two-part capsule 100 comprising a body portion such as the body portion 102 and a non-screw detachable cover such as the non-screw detachable cover 104 having an integrated nail polish applying element such as the nail polish applying element 106. As evident only the top part of the body portion 102 is visible, specifically an upper section of a reservoir such as the reservoir 108 defined by the body portion 102 and a neck section of the body portion 102 such as the neck section 110. The body portion 102, specifically the neck section 110 and the reservoir 108 are drawn in transparent form to allow view of the inner parts of the nail polish applying element 106, specifically an upper portion of a stem such as the stem 112, a radial sealing element such as the radial sealing element 130, a radial wiping element such as the radial wiping element 132 and an axial scaling element such as the axial sealing element 138.

A zoom view 304 of a section of the perspective view 304 presents a section of the radial scaling element 130 and the radial wiping element 132. As seen the radial wiping element 132 may be shaped to have a diameter 1 which is similar to the inner diameter of the neck section 110. However, the radial wiping element 132 may be shaped to have a diameter 2 which is larger than the inner diameter of the neck section 110. In another example, the radial wiping element 132 may be shaped to have a diameter 3 larger than the inner diameter of the neck section 110 which is even larger than diameter 2. As described herein before the diameter of the radial wiping element 132 may define how tightly it contacts peripherally the inner surface of the neck section 110 thus affecting its capacity and/or performance in collecting the residues of a nail polish such as the nail polish fluid 116 accumulated on the inner surface of the neck section 110 and push them towards the reservoir 108.

Figure 3B:
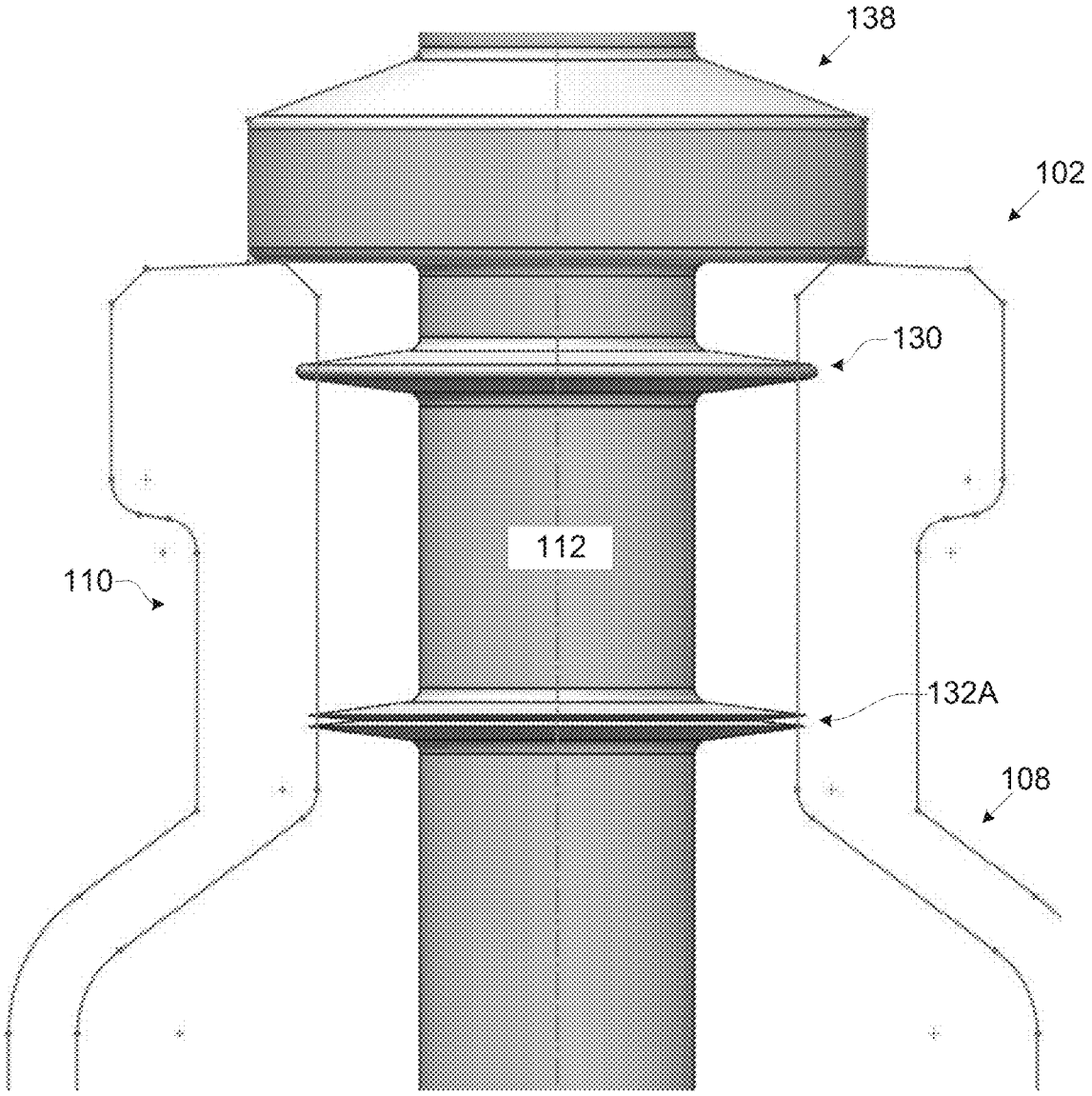

Optionally, as seen in FIG. 3B, presenting a front view of a segment of the exemplary two-part capsule 100, an exemplary radial wiping element 132A such as the radial wiping element 132 may be shaped to have a fork-like peripheral edge, in particular an elastic fork-like peripheral edge. The fork-like shaped peripheral edge may significantly improve efficiency of the radial wiping element 132A to collect the residues of a nail polish such as the nail polish fluid 116 accumulated on the inner surface of the neck section 110 and push them towards the reservoir 108.

Figure 3C:
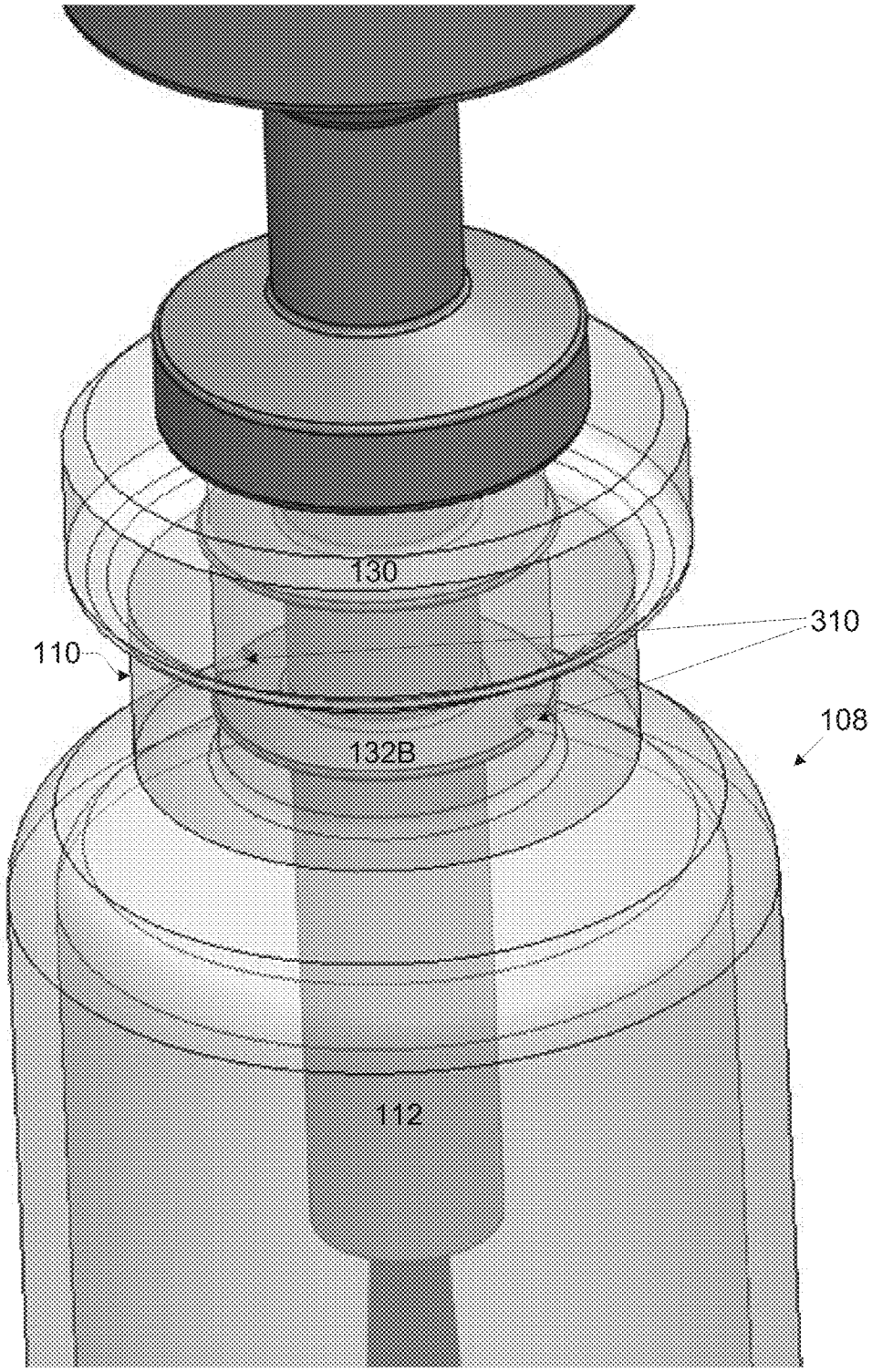

As seen in FIG. 3C, presenting a perspective view of a segment of the exemplary two-part capsule 100, the opening(s) in an exemplary radial wiping element 132B such as the radial wiping element 132 may comprise one or more grooves 310, for example, two grooves 310 forming openings between the radial wiping element 132B and the inner surface of the neck section 110 to enable passage of air between the reservoir 108 and the gap formed between the radial wiping element 132B and the radial sealing element 130. As evident, for any size of its diameter, the radial wiping element 132B is shaped such that the grooves 310 prevent contact of the radial wiping element 132B with the inner surface of the neck section 110 at the location of the grooves 310 thus leaving the opening for air passage between the reservoir 108 and the gap between the radial wiping element 132B and the radial sealing element 130.

Figure 3D:
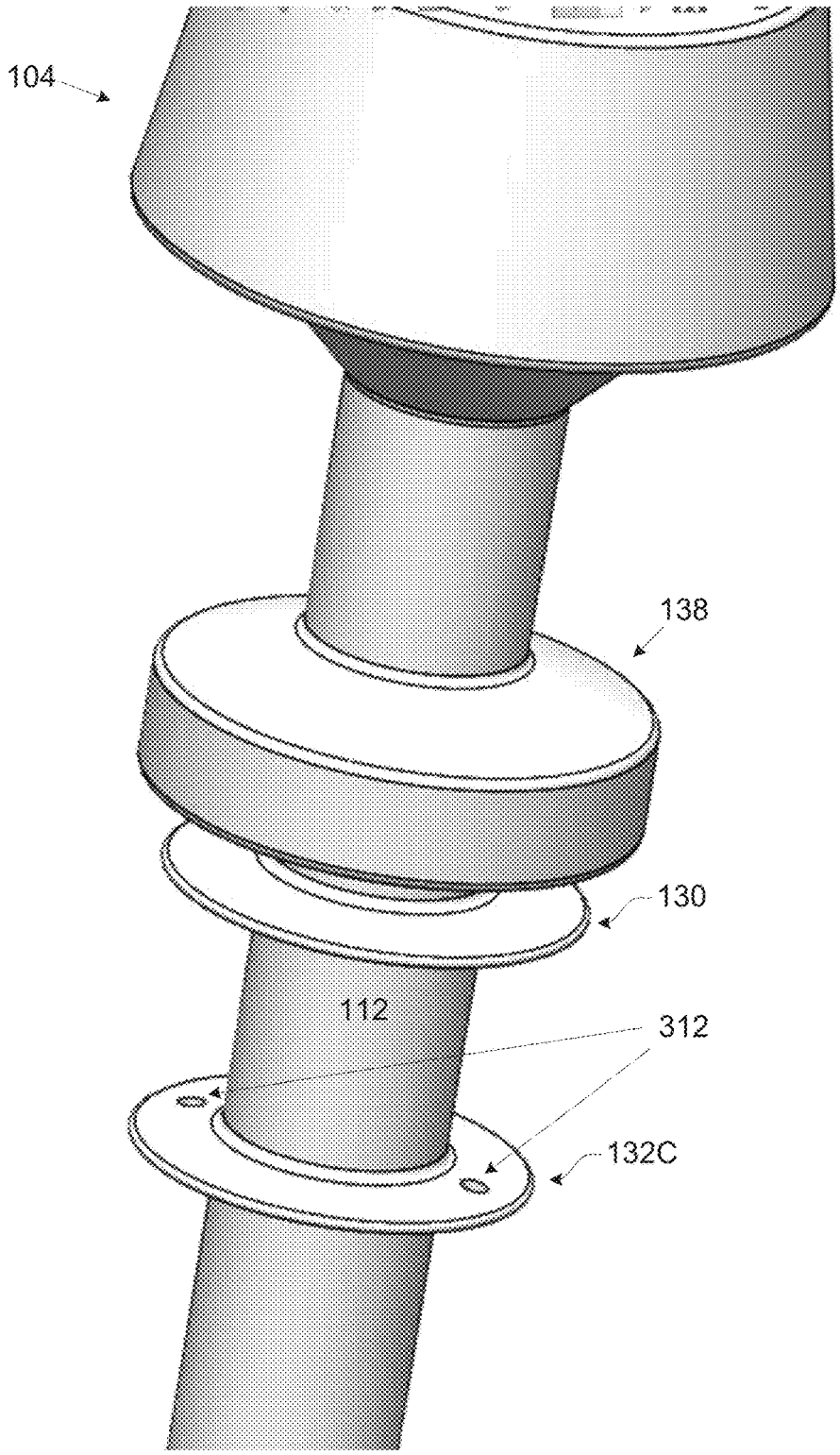

As seen in FIG. 3D, presenting a perspective view of a segment of the exemplary two-part capsule 100, the opening (s) in an exemplary radial wiping element 132C such as the radial wiping element 132 may comprise one or more holes 312, for example, two holes 312 in the radial wiping element 132C which may go through the radial wiping element 132C to enable passage of air between the reservoir 108 and the gap formed between the radial wiping element 132C and the radial sealing element 130.

Figure 3E:
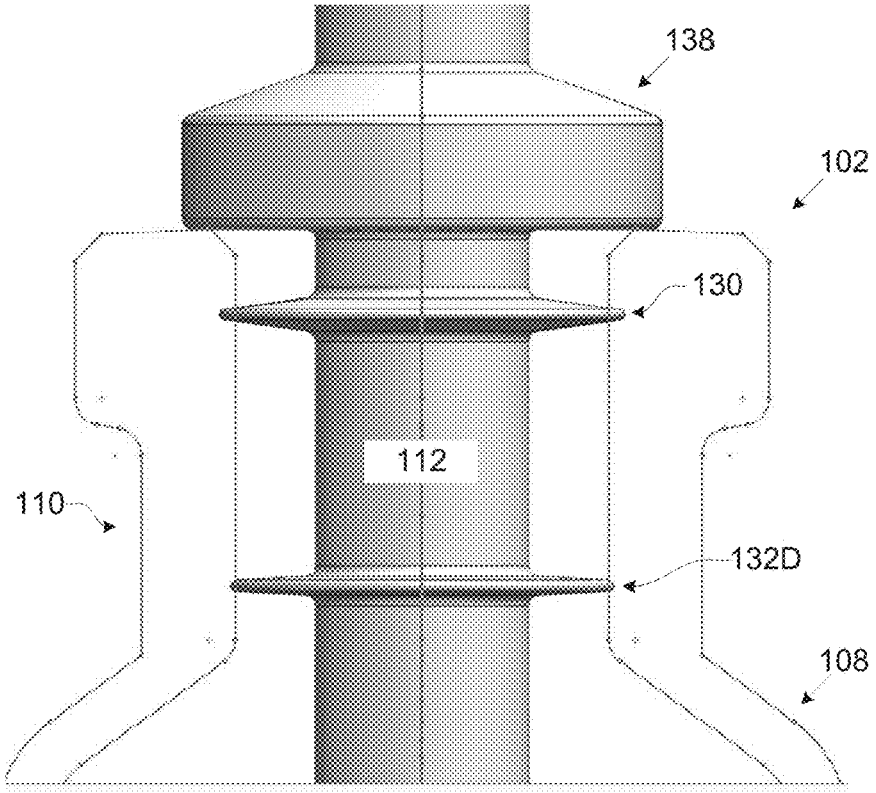
Figure 3F:
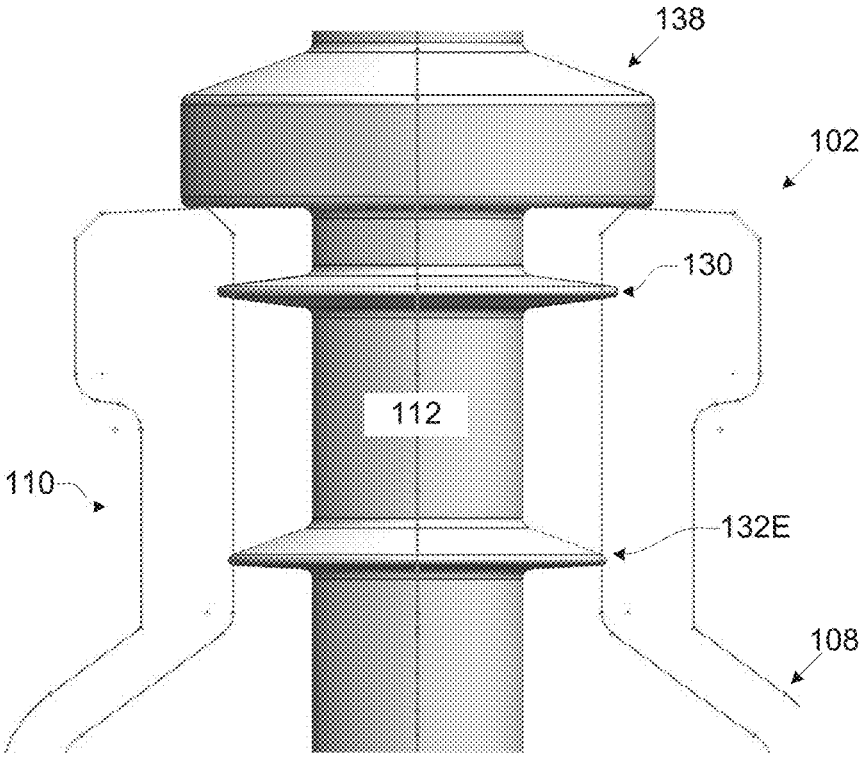
Figure 3G:
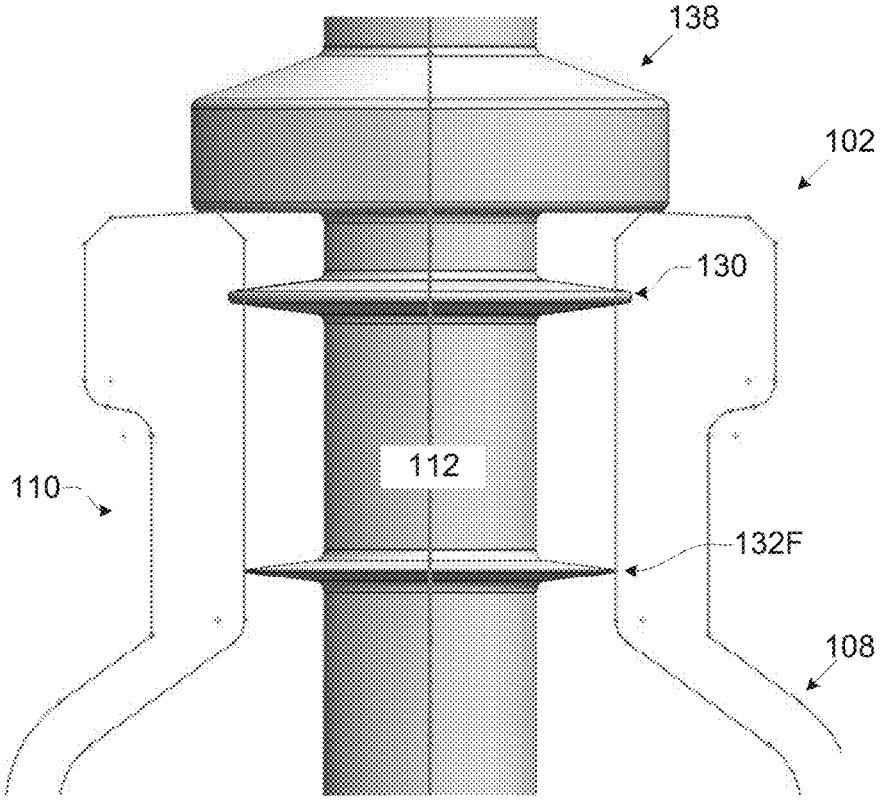

FIG. 3E, FIG. 3F and FIG. 3G, presenting front views of segments of the exemplary two-part capsule 100 with exemplary radial wiping elements 132D, 132E and 132F respectively such as the radial wiping element 132. The radial wiping elements 132D, 132E and 132F may be constructed of one or more elastic materials having a significantly high elasticity coefficient. As such, when the radial wiping elements 132D, 132E and 132F are moved through the neck section 110, for example, while inserting the stem 112 into the reservoir 108 and/or when extracting (pulling-out) the stem 112 from the reservoir 108, a peripheral edge of the elastic radial wiping elements 132D, 132E and 132F may deform thus forming an opening between the radial wiping elements 132D, 132E and 132F and the inner surface of the neck section 122 around at least part of the peripheral edge of the radial wiping elements 132D, 132E and 132F through which air may pass from one side of the radial wiping elements 132D, 132E and 132F to the other.

The clastic radial wiping elements 132D, 132E and 132F may be constructed to have different dimensions and/or peripheral edge profiles such that the peripheral edge may be more clastic and/or more rigid thus adjusting the wiping action of the radial wiping elements 132. For example, the radial wiping elements 132D may be significantly thin having a thin peripheral edge profile while the radial wiping elements 132E may be significantly thick having a thick peripheral edge profile. In another example, the radial wiping elements 132F may be constructed to have a sharp, razor-like peripheral edge profile. The different dimensions and/or edge profiles of the radial wiping element may be set, selected and/or defined to be more elastic and/or more rigid in order to adjust the wiping action of the radial wiping elements 132D, 132E and 132F.

Optionally, the elastic radial wiping elements 132D, 132E and/or 132F may be constructed and/or configured to have one or more normally closed openings which may open while the peripheral edge of the radial wiping elements 132D, 132E and/or 132F is pressed against the inner surface of the neck section 110. This means that while moving the nail polish applying element 106, comprising the stem 112 and the dispensing head 114, in and/or out of the body portion 102, the opening(s) may open to enable passage of air from one side of the radial wiping elements 132D, 132E and/or 132F to the other, specially from the reservoir 108 to the gap formed between the radial wiping elements 132D, 132E and/or 132F and the radial scaling element(s) 130. For example, one or more openings in the clastic radial wiping elements 132D, 132E and/or 132F may be covered with flaps which may normally cover the opening(s). However, while the peripheral edge of the radial wiping elements 132D, 132E and/or 132F is pressed against the inner surface of the neck section 110, at least part of the radial wiping elements 132D, 132E and/or 132F may deform causing the flap(s) to uncover the opening(s) thus enabling air to pass through the opening(s) from one side of the radial wiping elements 132D, 132E and/or 132F to the other.

Figure 3H:
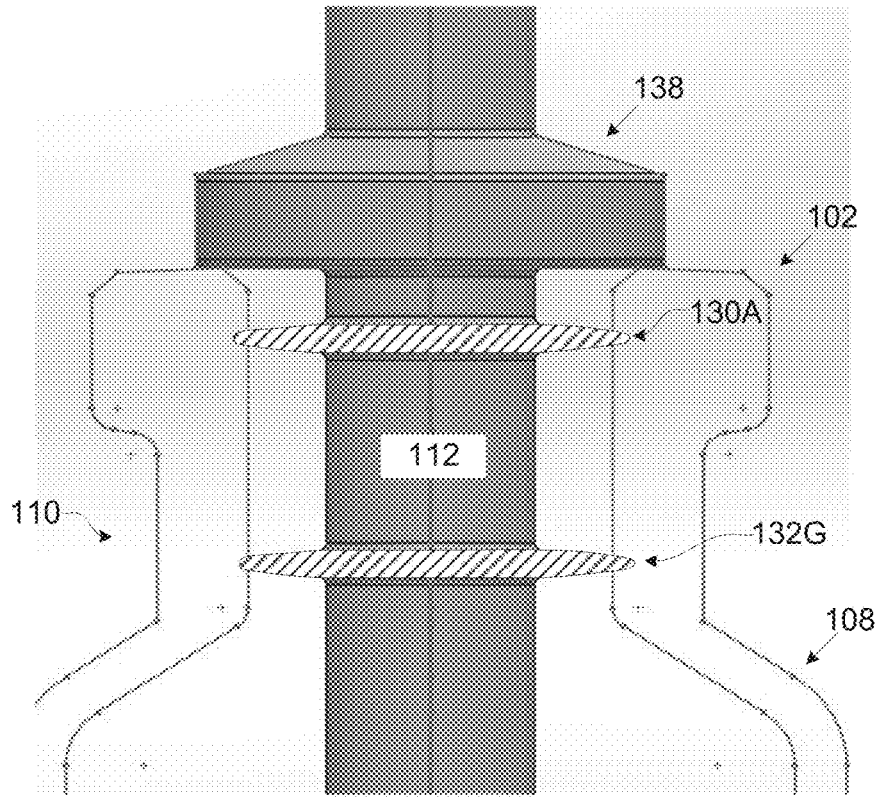

As seen in FIG. 3H, presenting a front view of a segment of the exemplary two-part capsule 100, an exemplary radial wiping element 132G such as the radial wiping element 132 may be constructed of a different material than the stem 112. In particular, the radial wiping element 132G may be constructed of a significantly more elastic material compared to the stem 112 which needs to be significantly rigid for efficient wiping and pushing the residues of the nail polish fluid 116, the radial wiping element 132, for example, the radial wiping element 132G should be significantly clastic.

Optionally, one or more radial sealing elements such as the radial sealing element 130, for example, a radial sealing element 130A may be also constructed of a different material than that of the stem 112 and optionally also different from the material used to construct the radial wiping element 132, for example, the radial wiping element 132G. For example, the radial sealing element 130A may be constructed of a significantly elastic material having a very high elasticity coefficient in order to efficiently attach to the inner surface of the neck section 110 and effectively seal it. Moreover, the dimeter of the radial sealing element 130A may be set to be larger than the inner dimeter of the neck section 110 in order to further increase the sealing effectivity.

Figure 3I:
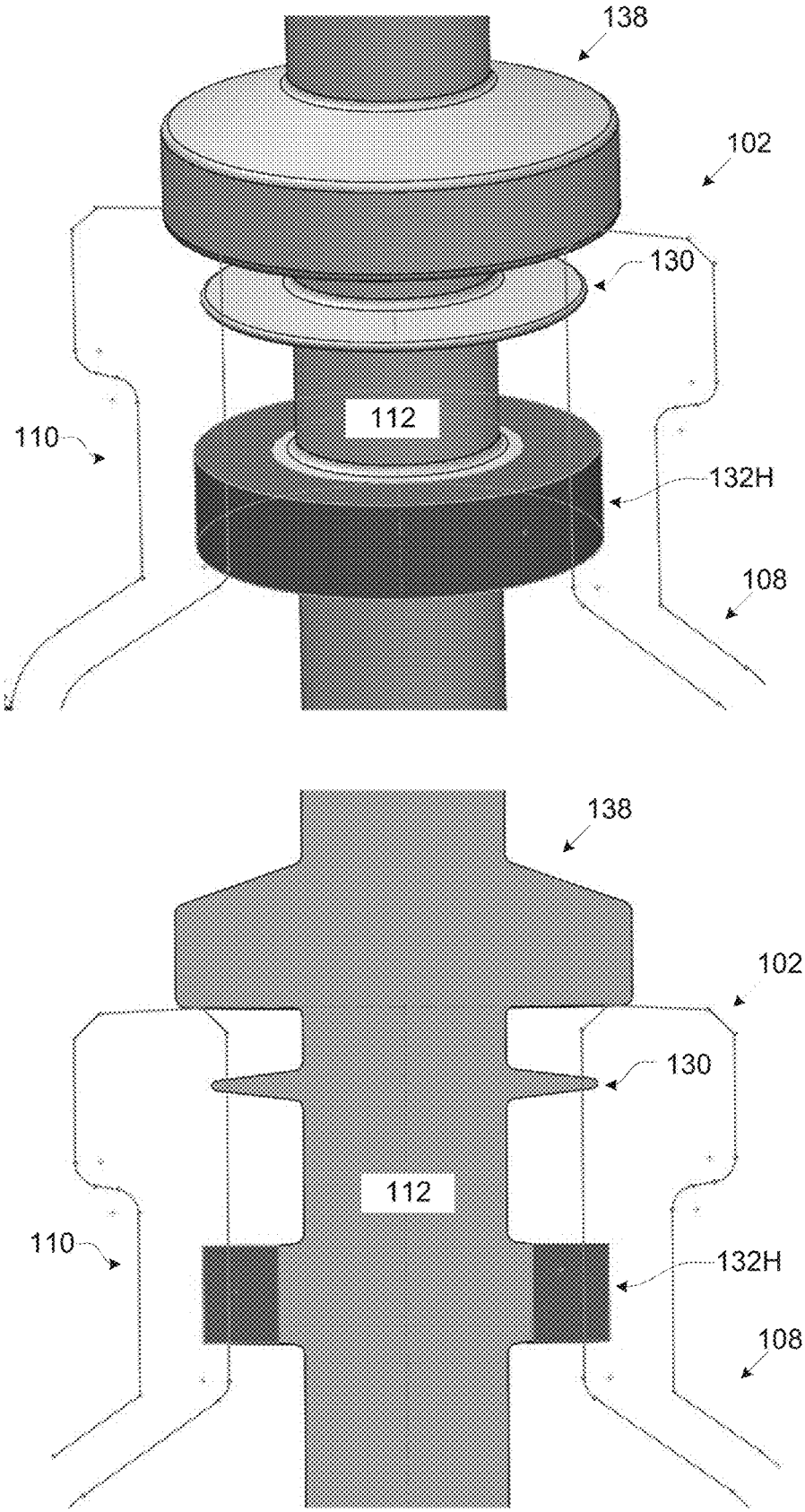

As seen in FIG. 3I, presenting a perspective view and a front view of a segment of the exemplary two-part capsule 100, an exemplary radial wiping element 132H such as the radial wiping element 132 may be constructed at least partially of one or more one or more porous materials which are air permeable, for example, a sponge and/or the like. This means that the openings in the radial wiping element 132H are formed by the inherent air permeable characteristic of the porous material(s) which may include a plurality of opening, voids and/or paths. Therefore, even while the peripherally disposed porous material(s) may be in full peripheral contact with the inner surface of the neck section 110, the radial wiping element 132H may not seal the neck section 110 but may rather enable passage of air between the reservoir 108 and the gap formed between the radial wiping element 132C and the radial sealing element 130. Moreover, the sponge like material may be disposed at least around the peripheral edge of the radial wiping element 132H to increase efficiently of wiping the residues of nail polish fluid 116 accumulated on the inner surface of the neck section 110.

Reference is made once again to FIG. 2.

As seen in FIG. 2, when attaching the non-screw detachable cover 104 to the body portion 102, as seen in the slightly open state of the capsule 100 presented in the left drawing, once the radial sealing element 130 comes into peripheral contact with the inner surface of the neck section 110 at the upper face 120 air may no longer escape from the body portion 102. Therefore, while the non-screw detachable cover 104 is further pushed down to close the capsule 100, the radial sealing element 130 also moves down pushing the air inwards the body portion.

As such, the air initially contained in the overall space defined between the top surface of the nail polish fluid 116 contained in the body portion 102 and the upper face 120 of the neck section 110 is gradually pressed into a smaller space defined between the top surface of the nail polish fluid 116 and radial sealing element 130. Eventually, in the fully closed state of the capsule 100 presented in the right drawing, the air initially contained in the overall space defined between the top surface of the nail polish fluid 116 and the upper face 120 is now contained in the smaller space defined between the top surface of the nail polish fluid 116 and radial sealing element 130.

The volume of a top space between the radial sealing element 130 and the upper face 120 may therefore contribute, affect and/or define the attachment (and detachment) force required for attaching and detaching the non-screw detachable cover 104 to and from the body portion 102. More accurately, the detachment force may be affected and/or defined by a ratio between the top space and the overall space since this ratio may define the pressure of air locked between the top surface of the nail polish fluid 116 and radial sealing element 130 in the closed state of the capsule 100. The attachment and/or detachment force may be further affected by friction between the radial scaling element(s) 130 and the neck section 110 as well as friction between the radial wiping element(s) 132 and the neck section 110.

The distance (height) between the radial sealing element 130 and the upper face 120 which defines the volume of the top space may be therefore set, defined and/or adjusted according to a predefined ratio between the volume of the top space and the volume of the overall space between the top surface of the nail polish fluid 116 contained in the body portion 102.

The predefined ratio may define, optionally combined with other parameters, such as, for example, the mechanical detachment and attachment force that the nail polish application apparatus is required to apply in order to open and close the capsule 100, i.e., the force required to detach and attach, respectively, the non-screw detachable cover 104 from and to the upper face 120 of the neck section 110 of the body portion 102.

For example, in order to define a lower force for detaching and attaching the non-screw detachable cover 104 from and to the upper face 120, the distance (height) between the radial scaling element 130 and the upper face 120 may be set according to a low ratio. In such case, the radial sealing element 130 may be located closer to the upper face 120 such that the volume of the space defined between the top surface of the nail polish fluid 116 and the radial sealing element 130 in the closed state of the capsule 100 is very similar to the volume of the overall space defined between the top surface of the nail polish fluid 116 and the upper face 120 in the open state thus building relatively low pressure in the closed state.

In another example, in order to define higher force for detaching and attaching the non-screw detachable cover 104 from and to the upper face 120, the distance between the radial scaling element 130 and the upper face 120 be set according to a higher ratio. In such case, the radial scaling element 130 may be located relatively further away from the upper face 120 such that the volume of the space defined between the top surface of the nail polish fluid 116 and the radial scaling element 130 in the closed state of the capsule 100 is significantly smaller than the volume of the overall space defined between the top surface of the nail polish fluid 116 and the upper face 120 in the open state thus building relatively high pressure in the closed state.

Moreover, the detachment/attachment force required for detaching and/or attaching the non-screw detachable cover 104 from and to the body portion 102 may be defined by a combination of the ratio between the top space and the overall space with one or more other parameters of the capsule 100. Such additional parameters may include, for example, a mechanical attachment force of the non-screw detachable cover 104 to the body portion 102. In another example, the additional parameters may include a diameter of the radial scaling element(s) 130 and/or a diameter of the radial wiping element(s) 132 since the level of overlap between the radial scaling and wiping elements and the inner surface of the neck section 110 may define the force required to move the nail polish element 106 in and out of the body portion 102. In another example, the additional parameters may include the elasticity coefficient of the material(s) from which the radial scaling and wiping elements are constructed since the force required to bend, twist, compress and/or curve the radial sealing and wiping elements may define the force required to move the nail polish element 106 in and out of the body portion 102. In another example, the additional parameters may include a friction coefficient of the inner surface of the neck section 110 and/or of the material(s) from which the radial sealing and wiping elements since the friction between the radial scaling and wiping elements and the inner surface of the neck section 110 may define the force required to move the nail polish element 106 in and out of the body portion 102.

Optionally, the radial sealing element(s) 130 and/or the radial wiping element(s) 132 may be shaped and configured to limit a lateral movement of the non-screw detachable cover 104 while the attached to the body portion 102, i.e., while the nail polish applying element 106 is inserted into the body portion 102. This may significantly increase controllability of the nail polish applying element 106 and/or the dispensing head 114 when dipping the dispensing head 114 in the nail polish fluid 116 contained in the reservoir 108.

Optionally, the radial wiping element(s) 132 may be further shaped and configured to push, towards the reservoir 108, residues of the nail polish fluid 116 accumulated on the inner surface of the neck section 110 when excessive nail polish fluid 116 is removed from the dispensing head 114 which is wiped against the inner surface of the neck section 120.

The dispensing head 114 may be wiped against the inner surface of the neck section 120 by the nail polish application apparatus moving the non-screw detachable cover 104 in one or more movement patterns with respect to the neck section 110, for example, a side-to-side movement, a forward-backward movement, an up-down movement, a circular movement and/or the like.

The amount of excessive nail polish removed from the dispensing head 114 may be computed, for example, to leave an amount of nail polish fluid 116 on the dispensing head 114 which is sufficient for application on one or more nail surfaces. In another example, the amount of excessive nail polish removed from the dispensing head 114 may be based on the volume that is estimated to be applied on the nail surface(s) to create a desired coating thickness.

The amount of excessive nail polish fluid 116 that may be removed from the dispensing head 114 while wiping the dispensing head 114 against the inner surface of the neck section 120 may be defined by one or more parameters. For example, the amount of excessive nail polish fluid 116 removed from the dispensing head 114 may be defined by the wiping movement pattern of the dispensing head 114 with respect to the neck section 110 which is derived from the wiping movement pattern of the non-screw detachable cover 104 with respect to the neck section 110. The wiping movement pattern may define the pressure applied on the nail polish applying element 106 which may translate to the pressure applied on the dispensing head 114 against the neck section 120 which may define the amount of excessive nail polish fluid 116 removed from the dispensing head 114. For example, moving the dispensing head 114 closer (tighter) to the neck section 110 such that the dispensing head 114 is pressed with higher pressure against the neck section 110 may lead to more nail polish fluid 116 being removed from the dispensing head 114. In another example, moving the dispensing head 114 further (less tight) from the neck section 110 such that the dispensing head 114 is pressed with lower pressure against the neck section 110 may lead to less nail polish fluid 116 being removed from the dispensing head 114.

In another example, the amount of excessive nail polish fluid 116 removed from the dispensing head 114 may be defined by a size of a contact area (contact surface) between the dispensing head 114 and the inner surface of the neck section 110, since the nail polish fluid may be distributed along the entire dispensing head 114. The size of the contact area the dispensing head 114 and the inner surface of the neck section 110 may be defined by a depth of inserting the dispensing head 114 into the neck section 120. For example, inserting the dispensing head 114 deeper into the neck section 110 may increase the contact area between the dispensing head 114 and the inner surface of the neck section 110 and may thus causing more excessive nail polish fluid 116 to be removed from the dispensing head 114. In contrast, inserting the dispensing head 114 less deep into the neck section 110 may reduce the contact area between the dispensing head 114 and the inner surface of the neck section 110 which may result in less excessive nail polish fluid 116 removed from the dispensing head 114.

The dispensing head 114 may comprise one or more materials and/or elements for dispensing the nail polish fluid 116 on a nail surface, specifically, at least partially elastic materials and/or elements, for example, a plurality of hair strands, one or more clastic natural and/or synthetic filaments and/or the like. In particular, the dispensing material(s) and/or element(s) are selected and/or configured to collect a portion of the nail polish fluid 116 when the dispensing head 114 is dipped in the nail polish fluid 116 contained in the reservoir 108. The dispensing material(s) and/or element(s) are further selected and/or configured to apply the collected nail polish fluid 116 on one or more nail surfaces of the user.

Figure 4:
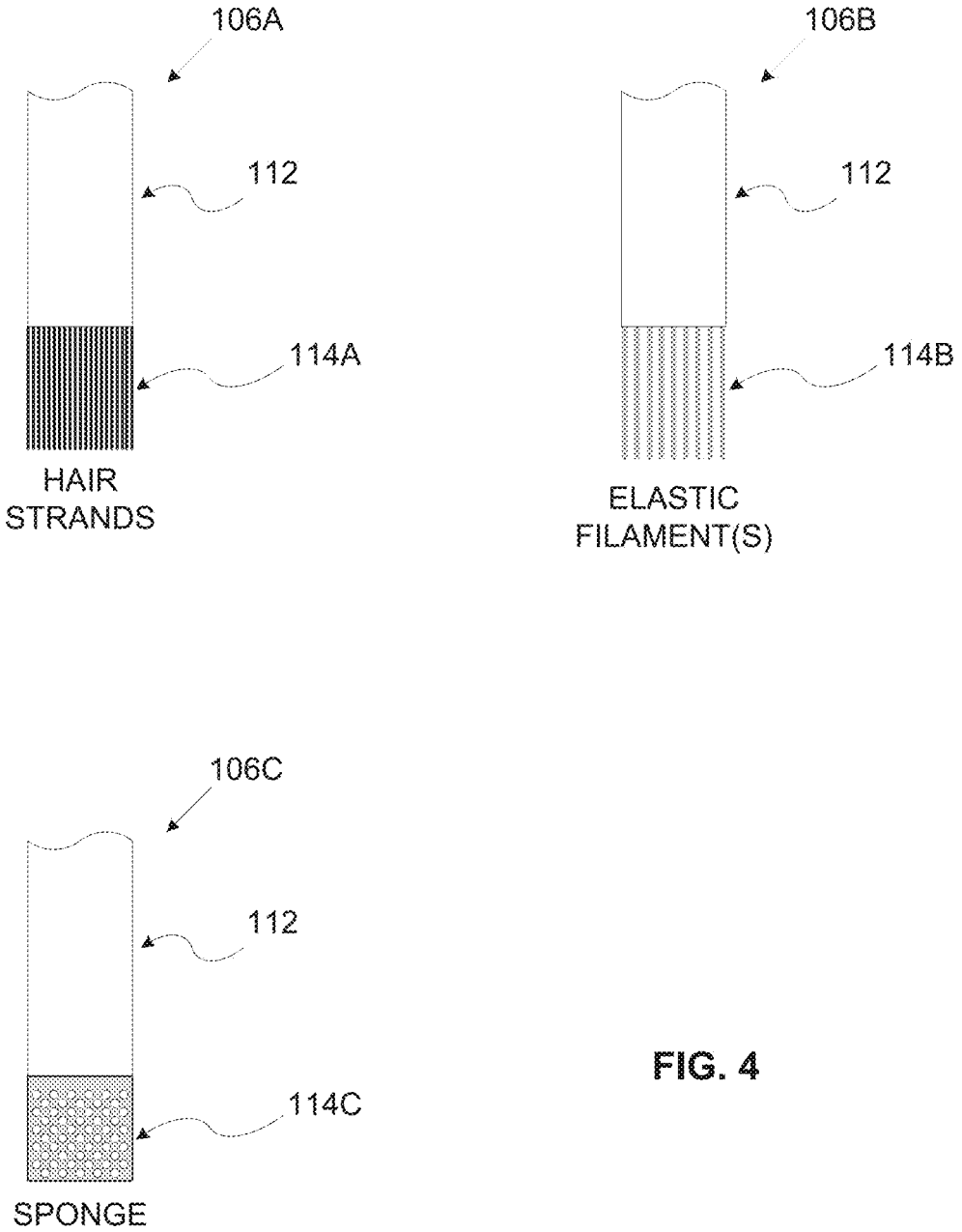
FIG. 4 is a schematic illustration of exemplary nail polish applying elements of a two-part nail polish capsule for use by a nail polish application apparatus, according to some embodiments of the present invention.

Reference is now made to FIG. 4, which is a schematic illustration of exemplary nail polish applying elements of a two-part nail polish capsule for use by a nail polish application apparatus, according to some embodiments of the present invention.

A first exemplary nail polish applying element 106A such as the nail polish applying element 106 may include a stem such as the stem 112 and an exemplary dispensing head 114A such as the dispensing head 114 comprising a plurality of hair strands. When dipped in a nail polish fluid such as the nail polish fluid 116 contained in a reservoir such as the reservoir 108, the hair strands may be anointed and/or smeared with the nail polish fluid 116 thus collecting a portion of the nail polish fluid 116. The anointed hair strands may be then moved over one or more nail surfaces of the user to apply the collected nail polish fluid 116 on the nail surface(s).

A second exemplary nail polish applying element 106B such as the nail polish applying element 106 may include a stem 112 and an exemplary dispensing head 114B such as the dispensing head 114 comprising one or more clastic filaments. The clastic filament(s) may be produced from one or more natural materials (e.g. animal, plant, etc.) and/or one or more synthetic materials. When dipped in the nail polish fluid 116 contained in the reservoir 108, the clastic filament(s) may be anointed and/or smeared with the nail polish fluid 116 thus collecting a portion of the nail polish fluid 116. The anointed clastic filament(s) may be then moved over one or more nail surfaces of the user to apply the collected nail polish fluid 116 on the nail surface(s).

A third exemplary nail polish applying element 106C such as the nail polish applying element 106 may include a stem 112 and an exemplary dispensing head 114C such as the dispensing head 114 comprising one or more sponge elements. The sponge element(s) may be produced from one or more materials, for example, polyester, polyurethane, vegetal cellulose and/or the like. When dipped in the nail polish fluid 116 contained in the reservoir 108, the sponge element(s) may be soaked and/or drenched with the nail polish fluid 116 thus collecting a portion of the nail polish fluid 116. The soaked sponge element(s) may be then moved over one or more nail surfaces of the user to apply the collected nail polish fluid 116 on the nail surface(s).

Figure 5:
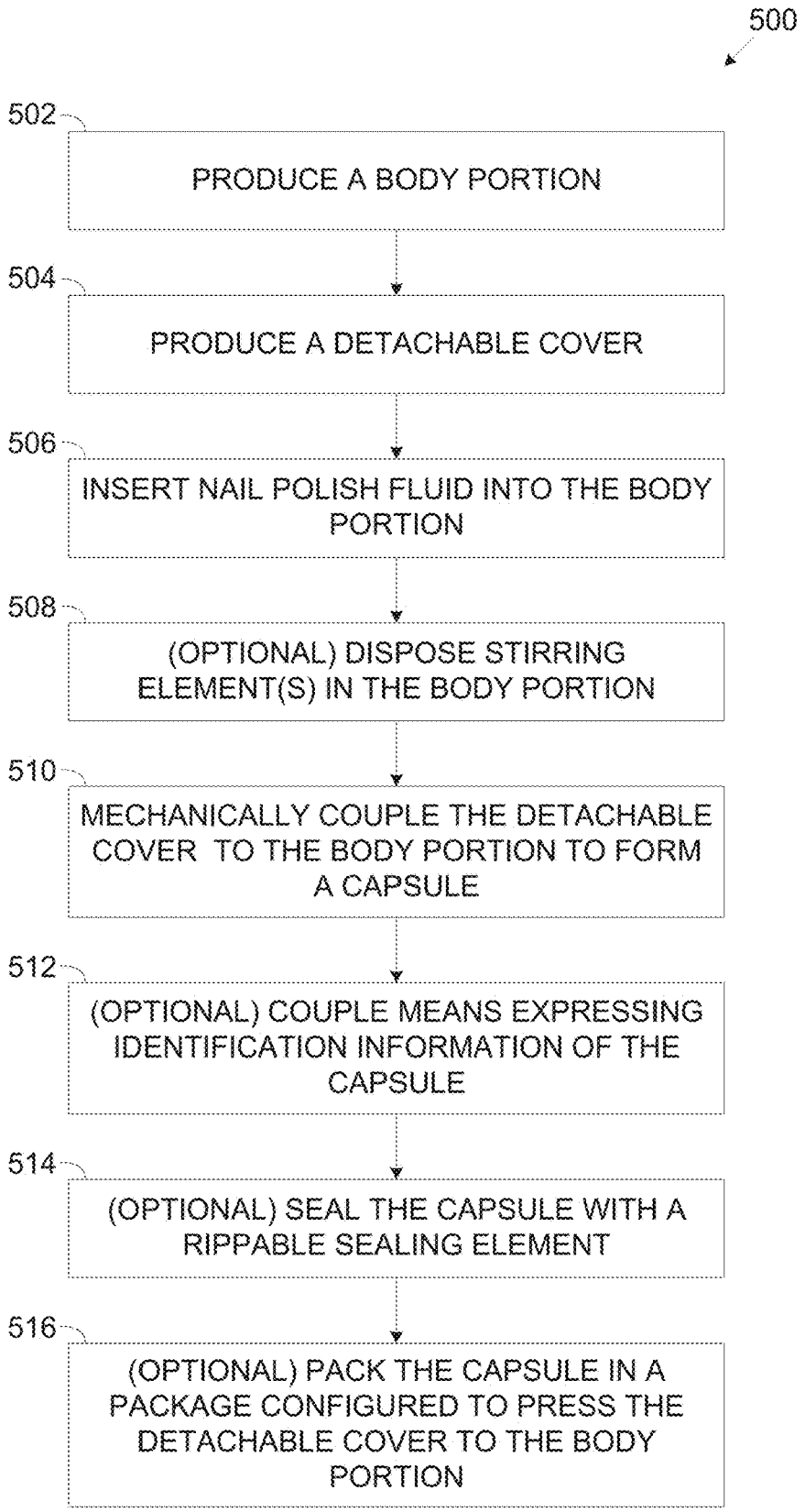
FIG. 5 is a flowchart of an exemplary process for producing an exemplary two-part nail polish capsule comprising a body portion and a non-screw detachable cover integrated with a nail polish applying element for use by a nail polish application apparatus, according to some embodiments of the present invention.

Reference is now made to FIG. 5, which is a flowchart of an exemplary process for producing an exemplary two-part nail polish capsule comprising a body portion and a non-screw detachable cover integrated with a nail polish applying element for use by a nail polish application apparatus, according to some embodiments of the present invention.

An exemplary process 500 may be applied to produce a one or more nail polish fluid storage and dispensing capsules, specifically two-part capsules such as the capsule 100 comprising a body portion such as the body portion 102 and a non-screw detachable cover 104 attached to the body portion 102.

As shown at 502, the process 500 starts with producing the body portion 102 for one or more capsules 100. The body portion 102 defining a reservoir such the reservoir 108 for storing nail polish fluid such as the nail polish fluid 116 and a neck section such as the neck section 110 may be produced from one or more materials, for example, a polymer, glass, metal, a ceramic material and/or the like through one or more production methods, for example, molding, hot rolling, forming, 3D printing, CNC machining and/or the like. Moreover, the body portion 102 may be produced of one or more recyclable materials, for example, glass, recyclable plastic (polymers) and/or the like.

Optionally, one or more of the material(s) used to produce the body portion 102 are characterized by a low permeability coefficient to prevent one or more components of a nail polish fluid such as the nail polish fluid 116, for example, the solvent and/or the like from diffusing through the body portion 102 and evaporating over time.

As shown at 504, the process 500 continues with producing a detachable cover such as the detachable cover 104 for one or more of the capsules 102, specifically a non-screw detachable cover 104 integrated with a nail polish applying element such as the nail polish applying element 106 comprising a stem such as the stem 112 and a dispensing head such as the dispensing head 114. The detachable cover 102 may be produced from one or more materials, for example, a polymer, glass, metal, a ceramic material and/or the like through one or more production methods, for example, molding, 3D printing, CNC machining and/or the like. Moreover, the detachable cover 104 and/or one or more of its components, for example, the nail polish applying element 106, the stem 112, the dispensing head 114 and/or the like may be produced of one or more recyclable materials, for example, glass, recyclable plastic (polymers) and/or the like. Optionally, one or more of the material(s) used to produce the detachable cover 104 are characterized by the low permeability coefficient to prevent the nail polish fluid 116 and/or part thereof from diffusing through the detachable cover 104 and evaporating over time.

The detachable cover 104 may be produced as a single piece inherently integrating together the cover and the nail polish applying element 106. However, the cover and the nail polish applying element 106 may be produced separately and mechanically coupled together using one or more techniques and/or methods as known in the art, for example, pinching, press fit, welding, soldering, gluing and/or the like.

The stem 112 comprising one or more radial sealing elements such as the radial scaling element 130 disposed above one or more radial wiping elements such as the radial wiping element 132 may be also produced from one or more materials, for example, a polymer, glass, metal, a ceramic material and/or the like through one or more production methods, for example, molding, 3D printing, CNC machining and/or the like. The stem 112 and the radial scaling element(s) 130 may be produced as one piece. However, one or more radial sealing elements 130 produced separately may be added to the stem 112 using one or more attachment methods, for example, rubber overfit, over-mold and/or the like.

The dispensing head 114 may be produced using one or more materials, for example, a polymer, metal, hair strands, organic hair, clastic filament(s) and/or the like through one or more production methods, for example, molding, 3D printing, extruding, CNC machining and/or the like. The dispensing element(s) of the dispensing head 114, for example, the plurality of hair strands such as in the dispensing head 114A, the one or more elastic filaments such as in the dispensing head 114B and/or the like may be fixated to the stem 112 by applying one or more methods, for example, pinching, press fit, welding, soldering, gluing, tufting and/or the like.

Optionally, one or more of the dispensing elements, specifically the synthetic elements may be produced as part of the stem 112, as part of the nail polish applying element 106 and/or as part of the integrated detachable cover 104 thus forming a single piece produced using one or more production methods, for example, molding, 3D printing, CNC machining and/or the like.

Optionally, an axial sealing elements such as the axial sealing element 138 may be integrated, applied and/or disposed in the detachable cover 104 and/or in an upper face such as the upper face 120 of the body portion 102 to seal the body portion 102 when the detachable cover 106 is mechanically attached (coupled) to the body portion 102. The sealing element(s) 138 may be mechanically coupled and/or integrated with the detachable cover 104 and/or the body portion 102. For example, a perimeter axial scaling element such as, for example, an O-ring, a gasket, an annular ring and/or the like may be disposed around the perimeter of the upper face 120 of the body portion 102. In another example, the axial sealing element 138 may be disposed around the stem 112 of the integrated nail polish applying element 106, in particular in proximity to the first end of the stem 112 such that the axial sealing element 138 is in physical contact with the upper surface 120 of the body portion 102. In another example, a perimeter axial sealing element 138 such as, for example, an annular ring may be disposed around the perimeter of the upper face 110 of the body portion 104.

As shown at 506, the nail polish fluid 116 is inserted into the body portion 102, specifically into the reservoir 108.

As shown at 508, which is an optional step, one or more stirring elements such as the stirring element 150 may be inserted into the body portion 102, specifically into the reservoir 108.

As shown at 510, the detachable cover 104 may be mechanically coupled (attached) to the body portion 102. In particular, the non-screw detachable cover 104 is not screwed to the body portion 102 but rather mechanically coupled to the body portion 102 using one or more methods, techniques and/or technologies, for example, press-fit, clamping, clasping, fastening and/or the like. For example, dimensions of the detachable cover 104 may be adapted and/or defined to fit into the body portion with a predefined level of force.

Optionally, in case the axial sealing element(s) 138 are disposed on the detachable cover 104 and/or on the body portion 102, the detachable cover 104 may be adapted to attach to the body portion 102 with a predefined clearance (air gap) where the sealing element(s) 138 are configured to maintain the coupling with the predefined level of force. Moreover, the stem 112 may be configured and/or shaped to fit into an opening such as the opening in an upper face 120 of the body portion 102. Strength of the mechanical coupling between the detachable cover 104 and the body portion 102 may be predefined in terms of detachment and/or attachment force, for example, 10 N.

As shown at 512, which is an optional step, one or more identification elements such as the identification elements 140 may be attached, integrated, printed, coupled and/or otherwise added to one or more of the capsules 100. The identification elements 140 expressing the identification data of the capsule 100 and/or part thereof may include, for example, one or more labels, one or more markings (e.g. printed, carved, molded, etc.), one or more NFC components, one or more RFID tags and/or the like. The identification elements 140 may be added to the capsule(s) 100 based on their nature and/or technology. For example, assuming the identification elements 140 include one or more labels and/or one or more RFID tags, the label(s) and/or the tag(s) may be glued to the capsule 100. In another example, assuming the identification elements 140 include markings printed on the capsule 100, one or more printing methods and systems may be applied to print the markings. In another example, assuming the identification elements 140 include markings engraved in the capsule 100 itself, the identification elements 140 may be applied to the capsule 100 as part of the production process of the body portion 102 as described in step 502 of the process 500 and/or as part of the production process of the detachable cover 104 as described in step 504 of the process 500.

As shown in 514, which is an optional step, one or more of the capsules 100 may be wrapped using a rippable scaling element, for example, a foil sheet such as, for example, a metal foil, a polymeric foil and/or the like. In particular, the rippable scaling element(s) may be disposed over at least part of the non-screw detachable cover 104 and at least part of the body portion 102, specifically at least part of the neck section 110 to seal the area of the upper face 120 where the non-screw detachable cover 104 is coupled to the neck section 110. In another example, the rippable scaling element(s) may include a muselet like element fitted over the non-screw detachable cover 104 to firmly attach it to the body portion 120.

As shown in 516, which is an optional step, one or more capsules 100 may be packed in a package configured to receive and accommodate the capsule(s) 100. The package may be designed and configured to limit movement of the detachable cover 104 with respect to the body portion 102 in a longitudinal axis of the capsule 100. Limiting and practically preventing movement of the detachable cover 104 with respect to the body portion 102 may ensure that the detachable cover 104 is fully connected and fixated to the body portion in order to improve scaling of the capsule 100. The package may be further designed and configured to maintain a predefined pressure on the detachable cover 104 and on the body portion 102 such that they are pressed against each other to further improve sealing of the capsule 100. of the and optionally pressed against the body portion 102, Improving the sealing of the capsule 100 may prevent spillage and/or evaporation of the nail polish fluid and/or its composition materials, in particular under extreme conditions such as, for example, high and/or low temperature, high and/or low pressure and/or the like during transportation, shipping, handling and/or storage.

One or more designs, structures, and/or implementations may be applied to configure the package to maintain the pressure between the detachable cover 104 and the body portion 102. For example, the package may be shaped to have dimensions which may allow insertion of the capsule(s) 100 into the package using a predefined force such that the detachable cover 104 and the body portion 102 may be pressed together and may not move with respect to each other. In another example, the package may include one or more mechanical provisions shaped and configured to maintain the pressure between the detachable cover 104 and the body portion 102. For example, the package may include one or more protrusions shaped to come in physical contact with at least part of the detachable cover 104 and at least part of the body portion 102. The capsule(s) 100 may be inserted into the package using a predefined force such that the detachable cover 104 and the body portion 102 may be pressed together and may not move with respect to each other.

Figure 6A:
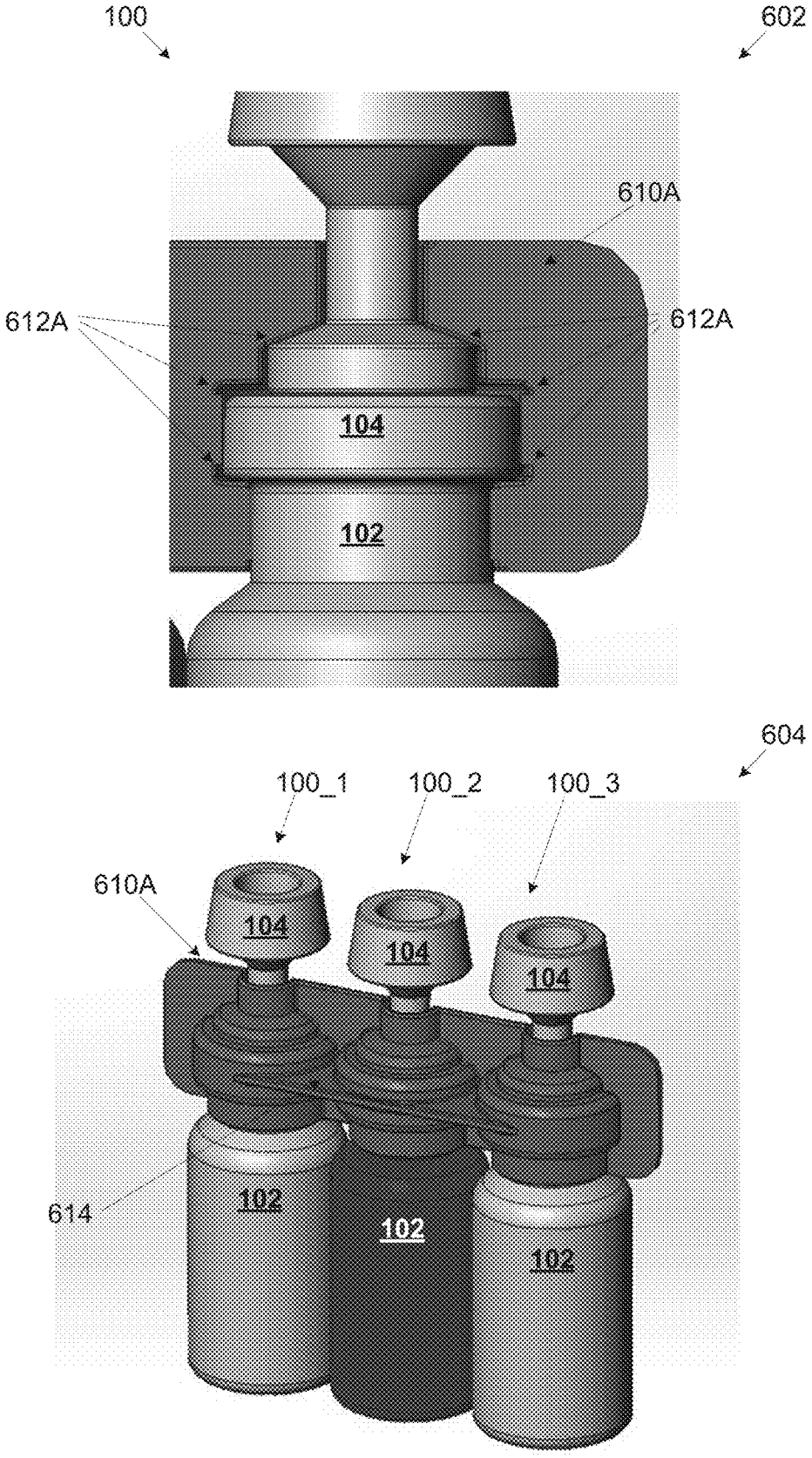
FIG. 6A and FIG. 6B are schematic illustrations of exemplary packages of two-part nail polish capsules for use by a nail polish application apparatus, according to some embodiments of the present invention.
Figure 6B:
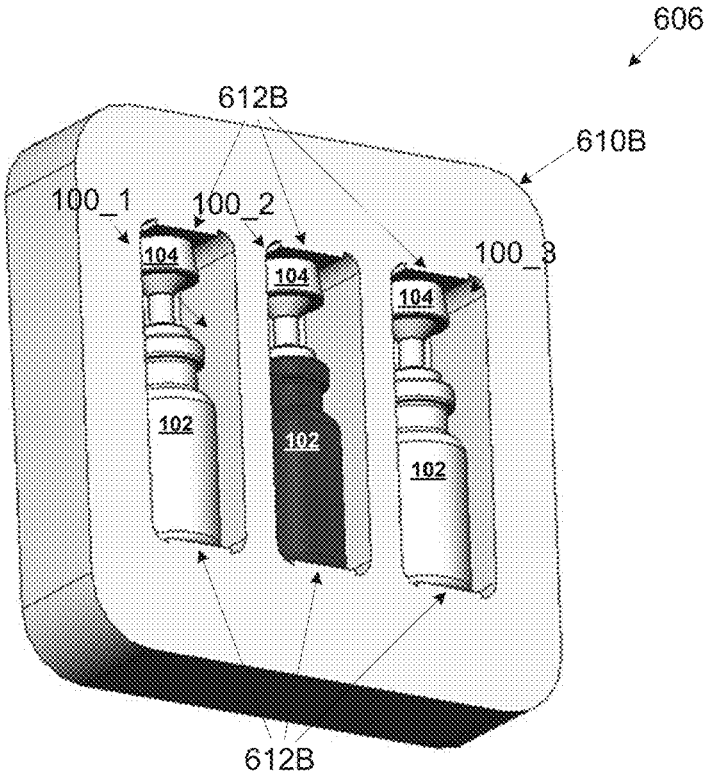
Figure 6B:
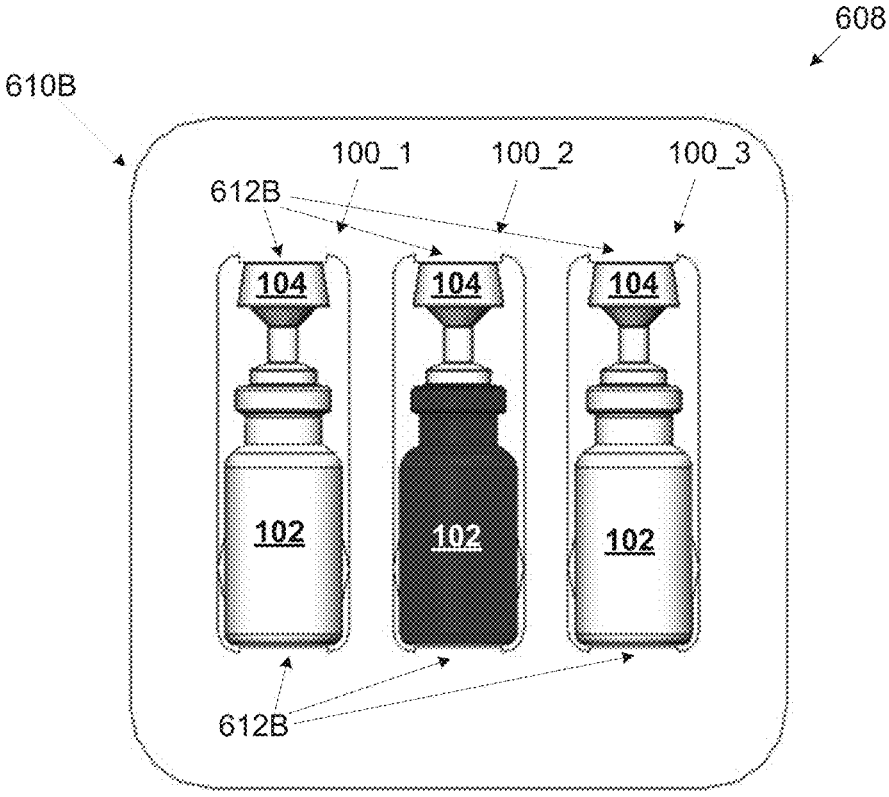

Reference is now made to FIG. 6A and FIG. 6B, which are schematic illustrations of exemplary packages of two-part nail polish capsules for use by a nail polish application apparatus, according to some embodiments of the present invention.

As seen at 602 illustrating a rear view of a first exemplary package 610A, the package 610A may include one or more protrusions 612A deployed, shaped and configured to come in physical contact with at least part of the detachable cover 104 such that the detachable cover 104 may not move, primarily in an upward direction but optionally in one or more other directions as well. The protrusion(s) 612A may be further deployed, shaped and configured to come in physical contact with at least part of the body portion 102 such that the body portion 102 may not move, primarily in a downward direction but optionally in one or more other directions as well. As such, one or more capsules such as the two-part capsule 100, in its closed state with the detachable cover 104 attached to the body portion 102, may be inserted, using a predefined force, into a designated location in the package 610A with respect to the protrusion(s) 612A such that the detachable cover 104 and the body portion 102 may not move with respect to each other optionally under a predefined pressure between them.

As seen at 604 illustrating a front view of the package 610A, the package 610A may be configured to host a plurality, for example, three two-part capsules 100, for example, a first capsule 100_1, a second capsule 100_2 and third capsule 100_3. As seen, the package 610A comprising the protrusions 612A deployed, shaped and configured to come in physical contact with at least part of the detachable cover 104 of each of the capsules 100_1, 100_2 and 100_3 may prevent the detachable cover 104 from moving, specifically in an upward direction. The protrusion(s) 612A may be further deployed, shaped and configured to come in physical contact with at least part of the body portion 102 of each of the capsules 100_1, 100_2 and 100_3 such that the body portion 102 may not move, specifically in a downward direction. As such, the capsules of 100_1, 100_2 and 100_3 may be inserted, while in closed state, into the package 610A using a predefined force to place the detachable cover 104 and the body portion 102 of each capsule 100 in their designated locations with respect to the protrusion(s) 612A such that the detachable cover 104 and the body portion 102 of each capsule 100 may not move with respect to each other and the pressure between them may be maintained.

The package 610A may further include one or more mechanical grabbing provisions 614 which may be used by a user to easily and conveniently insert and/or extract one or more of the capsules 100_1, 100_2 and/or, 100_3 in and/or out of the package 610A.

As seen at 606 and 608 illustrating a perspective view and a front view respectively of a second exemplary package 610B, the package 610B may include one or more protrusions 612B deployed, shaped and configured to come in physical contact with at least part of the detachable cover 104 such that the detachable cover 104 may not move, primarily in an upward direction and optionally in one or more other directions as well. The protrusion(s) 612A may be further deployed, shaped and configured to come in physical contact with at least part of the body portion 102 such that the body portion 102 may not move, primarily in a downward direction and optionally in one or more other directions as well. As such, one or more capsules such as the two-part capsule 100, in its closed state with the detachable cover 104 attached to the body portion 102, for example, capsules 100_1, 100_2 and 100_3 may be inserted, using a predefined force, into a designated location in the package 610B with respect to the protrusion(s) 612A such that the detachable cover 104 and the body portion 102 may not move with respect to each other optionally under a predefined pressure between them.

Optionally, the package may include one or more active pressure inducing elements, for example, a spring, a leaf spring, a rubber band and/or the like configured to apply pressure on the detachable cover 104 in the longitudinal axis towards the body portion 102 and/or apply pressure on the bottom surface of the body portion in the longitudinal axis towards the detachable cover 104. The tension applied by the pressure inducing element(s) may improve and/or maintain proper attachment of the detachable cover 104 to the body portion 102 which may further increase and/or enhance scaling of the body portion 102.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

As used herein the term "about" refers to ±10%.

The terms "comprises", "comprising", "includes", "including", "having" and their conjugates mean "including but not limited to". This term encompasses the terms "consisting of" and "consisting essentially of".

The phrase "consisting essentially of" means that the composition or method may include additional ingredients and/or steps, but only if the additional ingredients and/or steps do not materially alter the basic and novel characteristics of the claimed composition or method.

As used herein, the singular form "a", "an" and "the" include plural references unless the context clearly dictates otherwise. For example, the term "a compound" or "at least one compound" may include a plurality of compounds, including mixtures thereof.

The word "exemplary" is used herein to mean "serving as an example, an instance or an illustration". Any embodiment described as "exemplary" is not necessarily to be construed as preferred or advantageous over other embodiments and/or to exclude the incorporation of features from other embodiments.

The word "optionally" is used herein to mean "is provided in some embodiments and not provided in other embodiments". Any particular embodiment of the invention may include a plurality of "optional" features unless such features conflict.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals there between.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

It is the intent of the applicant(s) that all publications, patents and patent applications referred to in this specification are to be incorporated in their entirety by reference into the specification, as if each individual publication, patent or patent application was specifically and individually noted when referenced that it is to be incorporated herein by reference. In addition, citation or identification of any reference in this application shall not be construed as an admission that such reference is available as prior art to the present invention. To the extent that section headings are used, they should not be construed as necessarily limiting. In addition, any priority document(s) of this application is/are hereby incorporated herein by reference in its/their entirety.

What is claimed is:

1. A capsule integrated with a nail polish applying element for usage by a nail polish application apparatus, the capsule comprising:

a body portion defining a reservoir containing a nail polish fluid and a neck section; and a non-screw detachable cover mechanically coupled to an upper face of the neck section, the non-screw detachable cover having an integrated nail polish applying element comprising a dispensing head and a stem having at least one radial sealing element and at least one radial wiping element disposed one above the other;

wherein the at least one radial sealing element is configured to fully peripherally contact an inner surface of the neck section when the non-screw detachable cover is attached to the upper face and the stem protrudes into the body portion thus sealing the neck section while the at least one radial wiping element comprising at least one opening configured to enable passage of air between the reservoir and a gap formed between the at least one radial wiping element and the at least one radial sealing element.

2. The capsule of claim 1, wherein the at least one radial wiping element is disposed on the stem beneath the at least one radial sealing element.

3. The capsule of claim 1, wherein the nail polish fluid is a member of a group consisting of: nail polish fluid, base coating fluid, top coating fluid, drying material, nail art polish fluid and medical nail treatment fluid.

4. The capsule of claim 1, wherein a diameter of the stem is configured to be smaller than the diameter of the neck portion.

5. The capsule of claim 1, further comprising the at least one radial sealing element constructed of at least one elastic material is shaped to have a diameter larger than an inner diameter of the neck section.

6. The capsule of claim 1, wherein the at least one radial wiping element constructed of:

at least one elastic material is shaped to have a diameter similar to an inner diameter of the neck section; or at least one elastic material is shaped to have a diameter larger than an inner diameter of the neck section; or at least one elastic material is shaped to have a fork like peripheral edge; or at least one porous material which is air permeable such that the at least one opening is formed by the air permeable characteristic of the at least one porous material.

7. The capsule of claim 1, wherein the at least one opening comprises at least one groove formed in a peripheral edge of the at least one radial wiping element such that the at least one radial wiping element peripherally contacts the inner surface of the neck section with the exception of the location of the at least one groove.

8. The capsule of claim 1, wherein the at least one opening comprises at least one hole formed in the at least one radial wiping element.

9. The capsule of claim 1, wherein the at least one opening is formed by a deformation of a peripheral edge of the at least one radial wiping element constructed of at least one elastic material while the at least one radial wiping element is moved through the neck section portion.

10. The capsule of claim 1, wherein a distance of the at least one radial sealing element from the upper face is set according to a predefined ratio between: (1) a volume of a top space formed between the at least one radial sealing element and the upper face when the non-screw detachable cover is coupled to the upper face, and (2) a volume of an overall space formed between a top surface of the nail polish fluid contained in the body portion and the upper face while the capsule is horizontally leveled with the neck section facing upwards.

11. The capsule of claim 1, further comprising the at least one radial sealing element and/or the at least one radial wiping element are shaped to limit a lateral movement of the non-screw detachable cover.

12. The capsule of claim 1, wherein the at least one radial wiping element is configured to push, towards the reservoir, nail polish fluid residues accumulated on the inner surface of the neck section when the non-screw detachable cover is moved to wipe the dispensing head against the inner surface to remove excessive nail polish fluid from the dispensing head.

13. The capsule of claim 1, wherein the dispensing head is constructed of at least one member of a group consisting of: a plurality of hair strands and at least one elastic filament.

14. The capsule of claim 1, further comprising at least one of:

an axial sealing element disposed between the non-screw detachable cover and the upper face and at least one stirring object disposed inside the reservoir for stirring the nail polish fluid when the capsule is shaken.

15. The capsule of claim 1, further comprising a rippable sealing element disposed over at least part of the non-screw detachable cover and at least part of the neck section.

16. A method for manufacturing a capsule integrated with a nail polish applying element for usage by a nail polish application apparatus, comprising:

producing a body portion defining a reservoir adapted to contain nail polish fluid and a neck section;

producing a non-screw detachable cover mechanically coupled to an upper face of the neck section, the non-screw detachable cover having an integrated nail polish applying element comprising a dispensing head and a stem having at least one radial sealing element and at least one radial wiping element disposed one above the other, the at least one radial sealing element is configured to fully peripherally contact an inner surface of the neck section when the non-screw detachable cover is attached to the upper face and the stem protrudes into the body portion thus sealing the neck section while the at least one radial wiping element comprising at least one opening configured to enable passage of air between the reservoir and a gap formed between the at least one radial wiping element and the at least one radial sealing element;

inserting the nail polish fluid into the body portion; and mechanically coupling the non-screw detachable cover to the upper face of the body portion to seal an opening in the upper face.

17. The method of claim 16, further comprising disposing at least one stirring object inside the reservoir for stirring the nail polish fluid when the capsule is shaken.

18. The method of claim 16, further comprising coupling at least one identification means to the capsule, the at least one identification means comprising identification data of the capsule.

19. The method of claim 16, further comprising disposing a rippable sealing element over at least part of the non-screw detachable cover and at least part of the neck section to further seal the body portion.

20. The method of claim 16, further comprising packing the capsule in a package configured to accommodate at least one capsule, the package is further configured to limit movement of the detachable cover with respect to the body portion in a longitudinal axis of the capsule.

* * * * *